US008888661B2

(12) United States Patent
Ellis

(10) Patent No.: US 8,888,661 B2
(45) Date of Patent: Nov. 18, 2014

(54) ABDOMINAL MUSCLE EXERCISE MACHINE

(71) Applicant: Joseph K. Ellis, Ocala, FL (US)

(72) Inventor: Joseph K. Ellis, Ocala, FL (US)

( * ) Notice: Subject to any disclaimer, the term of this patent is extended or adjusted under 35 U.S.C. 154(b) by 0 days.

(21) Appl. No.: 13/967,188

(22) Filed: Aug. 14, 2013

(65) Prior Publication Data

US 2013/0331238 A1 Dec. 12, 2013

Related U.S. Application Data

(63) Continuation-in-part of application No. 13/992,744, filed as application No. PCT/US2011/065738 on Dec. 19, 2011.

(51) Int. Cl.
*A63B 21/00* (2006.01)
*A63B 21/06* (2006.01)

(52) U.S. Cl.
CPC ..... *A63B 21/159* (2013.01); *A63B 21/06* (2013.01)
USPC ..... 482/72; 482/96; 482/71; 482/95

(58) Field of Classification Search
USPC ..... 482/95, 96, 72, 51, 57, 71
See application file for complete search history.

(56) References Cited

U.S. PATENT DOCUMENTS

| | | | |
|---|---|---|---|
| 6,264,588 | B1 | 7/2001 | Ellis |
| 6,287,241 | B1 | 9/2001 | Ellis |
| 7,232,404 | B2 | 6/2007 | Nelson |
| 7,455,633 | B2 | 11/2008 | Brown |
| 7,585,263 | B2 | 9/2009 | Brown |
| 7,611,446 | B2 | 11/2009 | Chuang |
| 7,651,446 | B1 | 1/2010 | Eschenbach |
| 7,662,076 | B1 | 2/2010 | Ho |

*Primary Examiner* — Jerome W Donnelly
(74) *Attorney, Agent, or Firm* — Laurence P. Colton; Smith Risley Tempel Santos LLC

(57) ABSTRACT

A machine for exercising at least a user's abdominal muscles, the machine having a base having front and back ends; an arm lever mounted to the base near the front end of the base; a user platform moved by a user and/or by the arm levers, the user platform slidably and pivotably mounted to the base; and a linkage mechanism operatively connecting the arm lever to the user platform so that when the arm lever is moved towards the user platform, the user platform is moved towards the arm lever and a front end of the user platform is moved upwards, pivoting the user platform into an angled configuration, and when the arm lever is moved away from the user platform, the user platform is moved away from the arm lever and the front end of the user platform is moved downwards, pivoting the user platform into a horizontal configuration.

20 Claims, 23 Drawing Sheets

ABDOMINAL MUSCLE EXERCISE MACHINE

STATEMENT OF RELATED APPLICATIONS

This patent application claims the benefit of U.S. patent application Ser. No. 13/992,744 having a filing date of 9 Jun. 2013, which claims the benefit of International Application No. PCT/US2011/065738 having an international filing date of 19 Dec. 2011.

BACKGROUND OF THE INVENTION

1. Technical Field

This invention relates to the general technical field of exercise, physical fitness and physical therapy equipment and machines. This invention relates more specifically to the field of exercise equipment for exercising of the abdominal muscles.

2. Prior Art

Exercise, physical fitness and physical therapy equipment and machines are available in various configurations and for various purposes, and are available for all of the major muscle groups. The majority of such equipment and machines, especially in the exercise field, concentrate either on an aerobic or anaerobic workout or on specific areas or muscle groups of the body such as the legs, the hips and lower torso, the chest and upper torso, the back, the shoulders and the arms. The individual operations of these machines generally concentrate on a single muscle group such as biceps, pectorals, quadriceps and so forth. Other equipment and machines are designed to aid the user in the exercise regimen, such as to aid the elderly, handicapped, and/or infirm in an appropriate exercise regimen. There are numerous examples each of these different types of exercise equipment and machines.

Generally, such equipment and machines can be categorized into three broad categories: free weights, mechanically operated single action resistance machines, and electrically operated resistance machines. Mechanically operated single action resistance machines can be subcategorized into three broad categories: stack weight resistance operated, free weight resistance operated, and alternative resistance operated. Mechanically operated single action resistance machines are available for exercising, strengthening and rehabilitating various individual muscles, muscle groups, combinations of muscle groups, joints, and other parts of the body.

This inventor previously has developed a composite motion movement machine for use in connection with exercise and physical therapy equipment. U.S. Pat. No. 6,264,588 discloses this composite motion movement machine, which combines a moving actuating member and a moving user support, the composite motion movement machine having a support member, a frame on which the user support is located, the frame being pivotably connected to the support member, a truck in slidable engagement with the support member and the frame, an actuating member being pivotably connected to the support member and operatively connected to the truck, the actuating member being adapted to move between a first position and a second position, and a linking mechanism operatively connecting said actuating member with said truck, wherein, when the user moves the actuating member between the first position and the second position, the truck moves along rails on the support member, forcing the frame to pivot relative to the support member and causing the user to actuate a resistance weight, thus exercising, strengthening or rehabilitating certain of the user's muscles. This machine can be used in connection with a variety of different resistance or assistance mechanism, such as stack weights, free weights, and alternative weight resistance devices.

U.S. Pat. No. 6,287,241 discloses this inventor's improvement on leg press exercise apparatuses by utilizing composite motion movement combined with a moving actuating member and a moving user support, the leg press having a support member, a frame on which the user support is located, the frame being pivotably connected to the support member, a truck in slidable engagement with the support member and the frame, an actuating member on which a push plate is located, the actuating member being pivotably connected to the support member and operatively connected to the truck, the actuating member being adapted to move between a first position and a second position, and a linking mechanism operatively connecting the actuating member the truck, wherein, when the user pushes the actuating member between the first position and the second position, the truck moves along rails on the support member, forcing the frame to pivot relative to the support member and causing the user to actuate a resistance weight, thus exercising certain of the user's muscles. This machine can be used in connection with a variety of different resistance or assistance mechanism, such as stack weights, free weights, and alternative weight resistance devices.

U.S. Pat. No. 7,232,404 discloses an abdominal exercise machine designed to work the abdominal and oblique muscle groups. The abdominal exerciser includes a sled that is supported by and slides or rolls along at least one track. The upper body support is ergonomically positioned higher than the sled, and fixed to a cross bar supported by the track. The cross bar is designed to rotate forward to simulate an abdominal exercise crunch motion when the knees are brought within proximity of the upper body support.

U.S. Pat. No. 7,455,633 discloses an abdominal exerciser device designed to work the abdominal and oblique muscle groups. The abdominal exerciser includes a leg support that can slide or roll along a track and an upper body support. The abdominal exerciser device is designed to simulate an abdominal exercise crunch motion when the knees are brought within proximity of the upper body support.

U.S. Pat. No. 7,585,263 discloses an abdominal exercise machine designed to work the abdominal and oblique muscle groups. The abdominal exerciser comprises a carriage connected to a frame by a swing-arm that allows the carriage to swing along an arcuate path. In some embodiments, the carriage is connected to the frame by non-parallel first and second swing-arms. The carriage is adjustable so as to accommodate users of different sizes and to isolate different abdominal muscle groups. The abdominal exerciser device is designed to simulate an abdominal exercise crunch motion when the knees are brought within proximity of an upper body support.

U.S. Pat. No. 7,611,446 discloses an abdominal exercise machine and method for targeting the abdominal and oblique muscle groups. The abdominal exercise system includes a frame, carriage, and an upper body support. In one embodiment, the user places at least a portion of their lower body on the carriage. The user leans their forearms and elbows against an angled upper body support while grasping a set of handles to secure the user's upper body. In turn, the user swings the carriage back and forth along an arcuate path beginning at a position behind the upper body support and ending at a position in front of the upper support, thereby contracting and relaxing the abdominal muscle group.

U.S. Pat. No. 7,651,446 discloses an elliptical core cycle exercise apparatus that combines lower arm movements with knee movements to exercise the core muscles of an operator in a cyclic manner. The exercise apparatus has a separately supported knee platform for a portion of an operator coordinated with the motion of a lower arm platform. The knees of the operator follow an elliptical curve path in concert with the up and down movements of the lower arm platform to drive a flywheel for cardio core exercise of the abdominal, lower and upper back muscles. The obliques may also be exercised by a reposition of the lower legs on the knee platform.

U.S. Pat. No. 7,662,076 discloses an exercising machine that includes a front foot member, a rear foot member, an upright mounted on the front foot member to support a handlebar, two sliding tubes connected in parallel between the upright and the rear foot member, two slide members respectively coupled to the sliding tubes by a respective set of sliding wheels to hold a respective footplate for movement along the slide members, two elastic pull straps respectively inserted through the sliding tubes and connected between the upright and the slide members, and two tension adjusters for adjusting the tension of the elastic pull strap.

There are other machines for exercising other parts of the torso, such as the abdominal muscles, or combinations of muscles. Popular embodiments of abdominal muscle exercise devices include sitting crunch devices on which the user sits and performs crunch exercises, lying crunch devices that the user uses in a lying or prone position, and twisting devices that allow the user to twist the upper torso relative to the hips. The current abdominal exercise and physical therapy equipment and machine art generally use weight plates, weight stacks, free weights, user body weight, tensile resistance, or air resistance, or a combination of weight stacks or free weights with the user's body weight.

Current abdominal muscle exercise machines generally target only the abdominal muscles and no other muscles. However, many people would prefer to have one machine that targets additional muscles or muscle groups concurrently with the abdominal muscles. Such a machine would provide a more complete workout in the same amount of time, as at least two muscles or muscle groups could be exercised concurrently. Thus it can be seen that an abdominal muscle exercise machine that also allows the exercising of at least one additional muscle group would be useful, novel and not obvious, and a significant improvement over the prior art. It is to such a machine that the current invention is directed.

BRIEF SUMMARY OF THE INVENTION

Briefly, the present invention is an exercise machine for primarily exercising the abdominal muscles, and also exercising at least one additional muscle or muscle group, such as the latissumus dorsi, tensor fasciae latae, biceps, deltoids, and/or the trapezius, among others, depending on how the invention is used. In the typical or common abdominal exercise motion, the user performs a crunch motion in which the head and shoulders are brought forwards towards the knees by contracting the abdominal muscles. The present invention also allows the user to perform this motion, but also involves the arms and the legs in the exercise, providing for the exercise of the additional muscle groups.

The present invention can be used in at least three modes, user resistance, user plus additional resistance, and user resistance with counter resistance assistance. In the user resistance mode, the user's body weight is the only form of resistance used to conduct the exercise regimen. In one embodiment of the user resistance mode, the mechanical advantage or disadvantage to the user can be manipulated with certain adjustments incorporated into the structure of the invention to increase or decrease the difficulty of the exercise regimen. In the user plus additional resistance mode, additional resistance can be added via an optional resistance or assistance mechanism, such as free weights, a weight stack, hydraulic devices, pneumatic devices, clutch-brake devices, elastic devices, friction devices, springs, moment arm devices, or other weight resistance devices and mechanisms. In the user resistance with counter resistance assistance mode, a counter resistance force can be added such as free weights, a weight stack, gas springs, spring powered reels or the like to create a counter force that will effectively reduce the amount of resistance of the exercise created by the user's body weight, thereby effectively reducing the difficulty of the exercise regimen.

The invention generally comprises a stationary base supporting a user platform, arm levers, and an optional resistance or assistance mechanism. The base can be any suitable base, such as a set of formed or shaped parallel tubes, for supporting the working components of the invention. The user platform, and preferably a back end of the user platform, is slidably and pivotably mounted on the base and is structured and mounted on the base such that the user can kneel on the user platform while using the invention and slide the base forwards and backwards. The arm lever(s) can be separate levers or can be joined together to form one rigid single structure and are pivotably mounted on the base such that the user can grasp the arm lever(s) while using the invention and pivot the arm lever(s) backwards and forwards. The arm levers are operatively connected to the user platform via linkages and/or a linkage mechanism so that the arm levers and the user platform cooperate with each other during the exercise regimen. The connection point of the linkage mechanism to the user platform can be adjustable so as to vary the mechanical advantage or disadvantage to the user during the exercise regimen. The optional resistance or assistance mechanism is operatively connected to the arm levers and/or the user platform so as to provide additional resistance or assistance to the user during the exercise regimen.

The linkages and/or linkage mechanism (both of which will be referred to as the linkage mechanism in this specification) operatively connects or links the arm lever to the user platform. If the optional resistance or assistance mechanism is included, the linkage mechanism also operatively connects the resistance or assistance mechanism to the arm levers and/or the user platform. One embodiment of the linkage mechanism comprises at least one first linkage and at least one second linkage. The first linkage is connected at a first end to or operatively proximal to an arm lever and is connected at a second end to a first end of the second linkage. The second linkage is connected at a first end to the second end of the first linkage and is connected at a second end to or operatively proximal to the user platform, and preferably to a front end of the user platform. The linkage mechanism connects the arm levers to the user platform in such a manner that when the arm levers are pulled towards the user, and thus towards the user platform, the linkages are caused to move so as to move the user platform, and thus the user, towards the arm levers.

In one embodiment, the second linkage is pivotably mounted to the base at a location on the base between the arm levers and the user platform. The pivot point on the second lever is located between the first and second ends of the second linkage such that the second linkage acts as a first class lever. When the first linkage is caused to move or rotate in a downward direction, this forces and rotates the first end of the second linkage downwards, thus causing the second end of the second linkage to rotate upwards. As the second end of the second linkage rotates upwards, it also moves in the direction of and closer to the arm levers, thus both pulling the user platform forwards and forcing the front end of the user platform upwards. As the back end of the user platform is pivotably and slidably mounted to the base, the back end of the user platform remains attached to the base, resulting in the user platform angling upwards from back to front. When the first linkage is caused to move or rotate or pivot in an upward direction, this forces or allows and rotates or pivots the first end of the second linkage upwards, thus causing the second end of the second linkage to rotate or pivot downwards. As the second end of the second linkage rotates or pivots downwards, it also moves in the direction away from and farther from the arm levers, thus both pushing the user platform backwards and forcing the front end of the user platform downwards. As the back end of the user platform is pivotably and slidably mounted to the base, the back end of the user platform remains attached to the base, resulting in the user platform being horizontal, generally horizontal, or slightly sloped from back to front, which is considered to be the at rest or unactivated or initial or starting position.

The optional resistance or assistance mechanism can be mounted on the invention at various alternative locations so long as the resistance or assistance mechanism is operatively connected to the invention so as to impart additional resistance or assistance to the user during the exercise regimen. In one embodiment, the resistance or assistance mechanism is mounted to the second linkage and operatively connected to the base such that when the second linkage is moved during the exercise regimen, the resistance or assistance mechanism moves as well. In another embodiment, the resistance or assistance mechanism is mounted to the base and operatively connected to the second linkage such that when the second linkage is moved during the exercise regimen, the resistance or assistance mechanism acts upon the second linkage. The degree of weight resistance of the resistance or assistance mechanism can be controlled by the user. For example, if the resistance or assistance mechanism comprises a free weight bar, additional weights can be added to or removed from the weight bar in a conventional manner. Other resistance or assistance mechanisms can be used in their conventional manners.

The invention also can include a rotation bearing support plate on which the user platform is mounted. The rotation point for the user platform preferably is at or about perpendicular to the user's thighs in the initial or starting position. The rotation bearing support plate can provide for free rotation of the user platform or angled placement of the user platform. The user platform is rotatably mounted on the rotation bearing support plate, and the rotation bearing support plate is slidably and pivotably mounted on the base. The linkage mechanism operatively connects or links the arm levers to the rotation bearing support plate in a manner analogous to that already disclosed such that the activation of the invention by pulling and pushing on the arm levers causes the rotation bearing support plate to slide and pivot in the manner already disclosed in connection with the user platform. While the rotation bearing support plate is in motion or stationary, the user platform can be rotated relative to the rotation platform. The range of motion of the free rotation of the rotation bearing support plate can be restricted such that the clockwise or counter clockwise motion of rotation of the rotation bearing support plate will have a stopping point mechanism to prevent over-rotation that could be hazardous to the user. Alternatively or additionally, a locking/unlocking mechanism allows the user platform to be unlocked and rotated relative to the rotation bearing support plate such that the user platform can be set at a desired angle relative to the rotation bearing support plate and locked at that angle.

The invention also can include adjustment means or mechanisms so as to allow the user platform, the arm levers, the linkages, the rotation bearing support plate, and/or the resistance or assistance mechanism to be adjusted to fit the user. Thus, each of the components of the invention is or can be adjustable so as to provide a comfortable and appropriate exercise regimen.

In operation, prior to initiating the exercise regimen, the user can adjust the position of the arm levers, the position of linkage mechanism, the position of the user platform, and/or the angle of the user platform, if adjustment mechanisms are included. Also, if the invention includes an additional resistance or assistance mechanism, the user can adjust the amount of additional resistance or assistance desired for the exercise regimen. The user kneels on the user platform and grasps the arm levers, which are in the at rest or unactivated position. The user pulls on the arm levers while contracting the abdominal muscles. The pulling on the arm levers causes the first linkage to move or rotate or pivot in a downward direction, thus forcing and rotating or pivoting the first end of the second linkage downwards, thus causing the second end of the second linkage to rotate or pivot upwards. As the second end of the second linkage rotates or pivots upwards, it also moves in the direction of and closer to the arm levers, thus both pulling the user platform forwards and forcing the front end of the user platform upwards, resulting in the user platform angling upwards from back to front. The contracting of the abdominal muscles also causes the user's hips to rotate forwards, thus also pulling the user platform forwards. The overall result is that the user conducts a crunch motion in which the user's knees are pulled towards the user's head and shoulders. The user may pull the arm levers part way or all the way to the fully activated position.

After the user has pulled the arm levers part way or all the way to the fully activated position so as to have conducted the crunch motion, the user can hold the arm levers in the activated position for additional exercise of the abdominal muscles. The user then allows the arm levers to move back towards or to the at rest position, which causes the first linkage to move or rotate or pivot in an upward direction, thus forcing or allowing and rotating or pivoting the first end of the second linkage upwards, thus causing the second end of the second linkage to rotate or pivot downwards. As the second end of the second linkage rotates or pivots downwards, it also moves in the direction away from and farther from the arm levers, thus both pushing the user platform backwards and forcing the front end of the user platform downwards, resulting in the user platform moving back to the generally horizontal starting position.

Additionally, when the user pulls and pushes the arm levers, the user can contract and release arm, back, and shoulder muscles, such as the biceps, deltoids, latissumus dorsi, and/or trapezius, therefore also exercising these muscles. Further, when the user moves the user platform, the user can contract and release the hip and quadriceps, therefore also exercising these muscles.

The user can repeat the pulling and pushing (releasing) action a number of times so as to complete a set of exercises. As can be seen, the present invention can exercise at least the abdominal muscles and also at least one other muscle or set of muscles, thus giving the user a more complete workout.

These features, and other features and advantages of the present invention will become more apparent to those of ordinary skill in the art when the following detailed description of the preferred embodiments is read in conjunction with the appended figures in which like reference numerals designate like elements throughout the several views.

DETAILED DESCRIPTION OF PREFERRED EMBODIMENTS

Exemplary preferred embodiments are disclosed below in connection with the attached drawings. Throughout this specification, various terms will be used to describe various elements or sets of elements, features or sets of features, and devices or sets of devices. For example, the term actuating means or actuating device will be used to describe any bar, handle, pad, or other element that is operatively connected to the moment arm resistance or assistance mechanism. The term at rest and unactivated and starting will be used to describe when the user is not engaging the device, or only minimally so. The term activated and operating will be used to describe when the user is engaging the device. The terms pull and push, when referring to the user operating the arm levers or device, will be used to describe any motion or movement by a user on the arm levers or device to activate weight resistance including but not limited to pulling, pushing, squeezing, twisting, and rotating.

Figure 1:
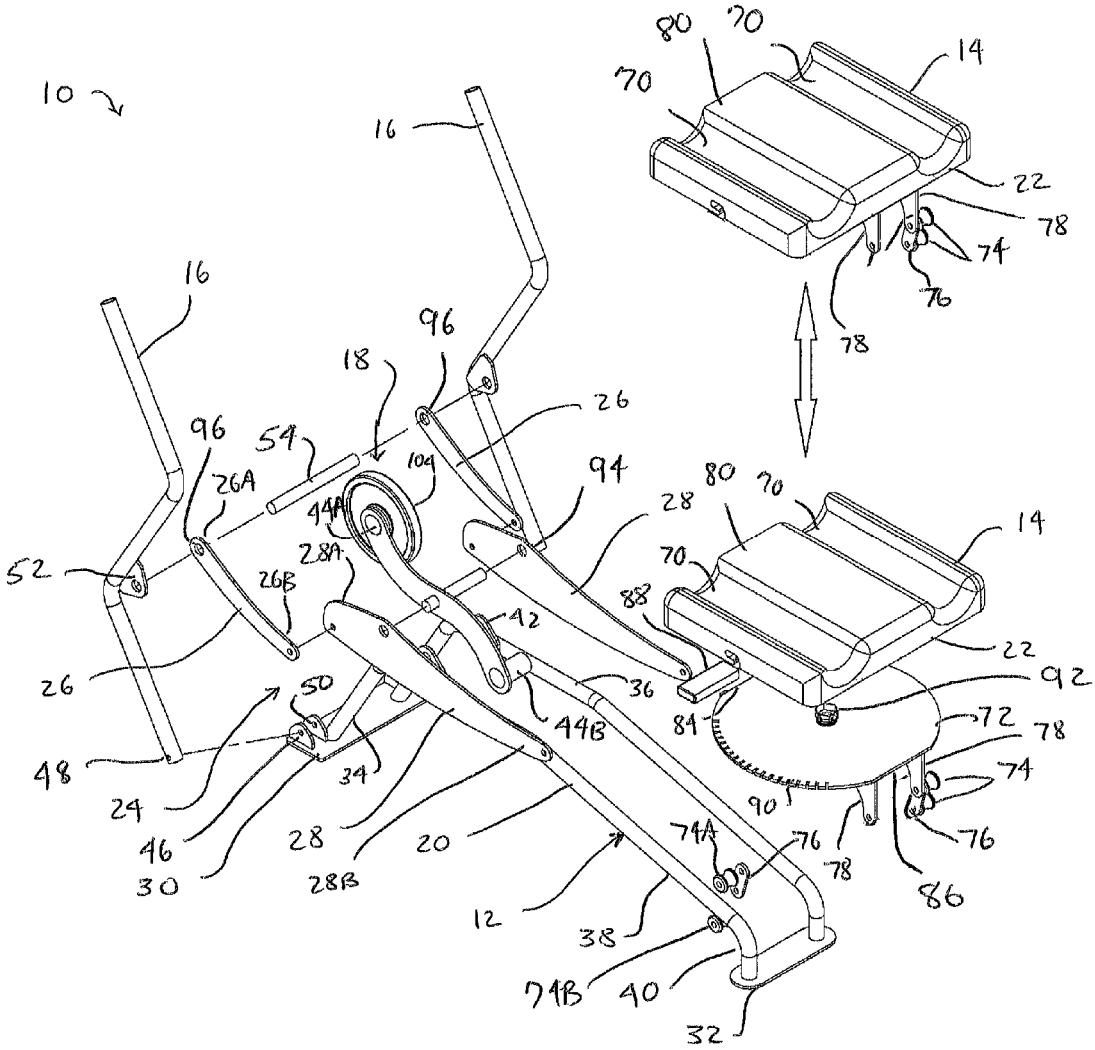
FIG. 1 is an exploded view of a first embodiment of the invention showing a user platform with and without a rotation bearing support plate.
Figure 2:
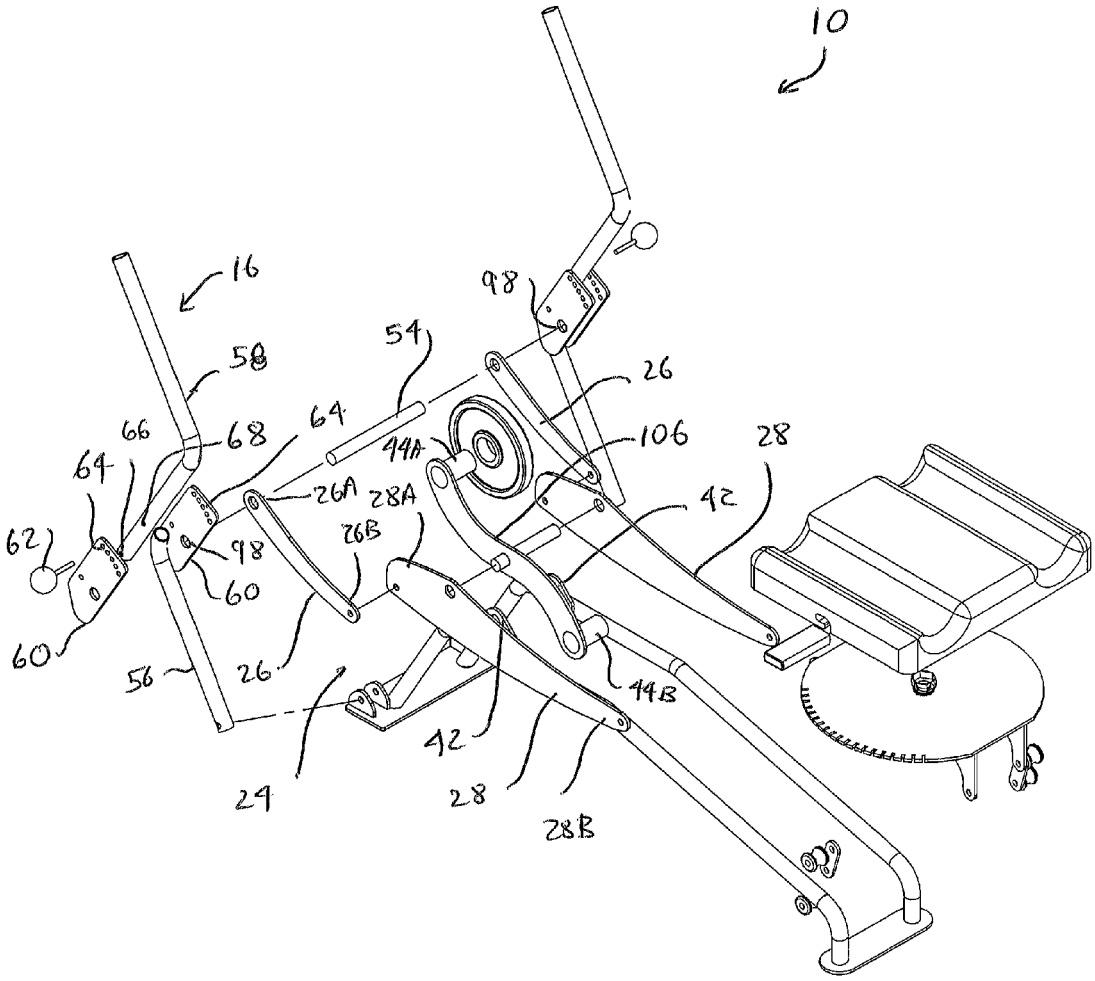
FIG. 2 is an exploded view of a second embodiment of the invention showing adjustable arm levers.
Figure 3:
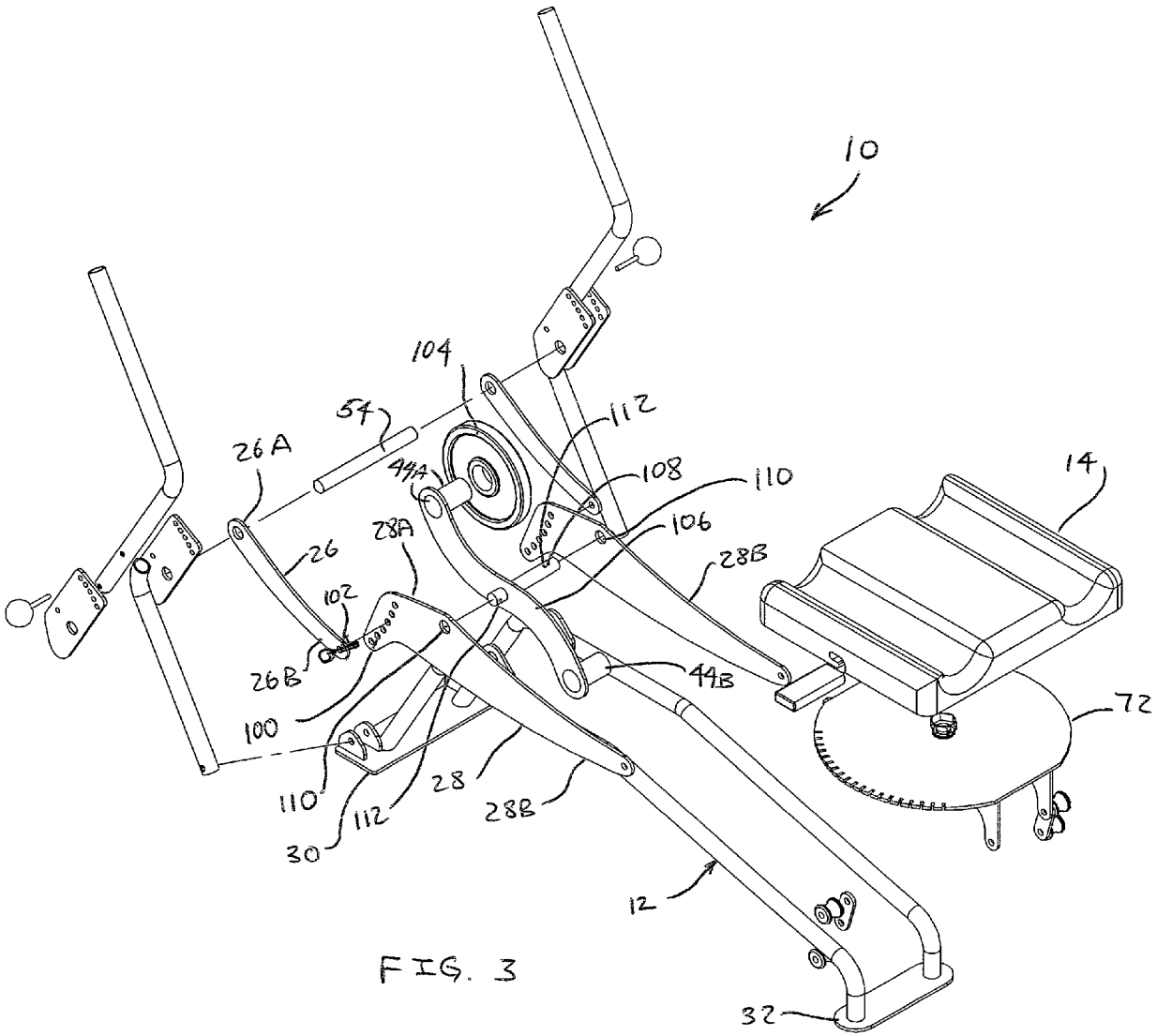
FIG. 3 is an exploded view of a third embodiment of the invention showing adjustable arm levers and an adjustable linkage mechanism with a weight on a front weight peg.

Referring now to FIGS. 1-3, exploded views of three representative embodiments of the invention are shown. FIG. 1 shows a first embodiment showing a user platform with and without a rotation bearing support plate. FIG. 2 shows a second embodiment showing adjustable arm levers. FIG. 3 shows a third embodiment showing adjustable arm levers and an adjustable linkage mechanism.

Generally, the machine 10 comprises a stationary base 12 supporting a user platform 14, arm levers 16, and an optional resistance or assistance mechanism 18. The base 12 can be any suitable base, such as a set of formed or shaped parallel tubes 20, for supporting the working components of the machine 10. The user platform 14, and preferably a back end 22 of the user platform 14, is slidably and pivotably mounted on the base 12 and is structured and mounted on the base 12 such that the user U can kneel on the user platform 14 while using the machine 10 and slide the base 12 forwards towards the arm levers 16 and backwards away from the arm levers 16. The arm levers 16 are pivotably mounted on the base 12 such that the user U can grasp the arm levers 16 while using the machine 10 and pivotably move at least upper portions the arm levers 16 backwards away from the user platform 14 and forwards towards the user platform 14. The arm levers 16 are operatively connected to the user platform 14 via linkages 26, 28 and/or a linkage mechanism 24 so that the arm levers 16 and the user platform 14 cooperate with each other during the exercise regimen. The optional resistance or assistance mechanism 18 is operatively connected to the arm levers 16 and/or the user platform 14 so as to provide additional resistance or assistance to the user U during the exercise regimen.

One embodiment of the base 12 comprises two (2) shaped tubes 20, a front stand 30 and a rear stand 32. Tubes 20 are stably connected to stands 30, 32 so that the combination of tubes 20 and stands 30, 32 forms a stable base adequate to stably support the remainder of the machine 10 and a user U, as well as being able to stably withstand the movement of the machine 10 during use. Tubes 20 are connected to stands 30, 32 such that tubes 20 are parallel or approximately parallel to each other approximately nine (9) inches to twenty-four (24) inches apart. Tubes 20 form a generally arched configuration between stands 30, 32, with the high point of the arch approximately six (6) inches to twenty-four (24) inches above the floor. As disclosed in more detail below, the apex of the arch can be an extended horizontal stretch of the tubes 20.

Tubes 20 generally are similar in shape, size, and structure to each other and can comprise three (3) or four (4) sections 34, 36, 38, 40. The first section 34 acts as a front riser and extends upwardly and preferably backwardly from the front stand 30. The second section 36 acts as a fulcrum 42 support for the linkage mechanism 24 and the resistance or assistance mechanism 18 and extends generally horizontally and backwardly from the first section 34. The third section 38 acts as a user platform 14 support and extends generally horizontally or downwardly from the second section 36. The fourth section 40 acts as a rear riser and extends upwardly and preferably forwardly from the rear stand 32 to the third section 38. The second section 36 and the third section 38 can be a single straight or curved combined section. The sections 34, 36, 38, 40 can be formed from a single piece of tubing or other material or can be two (2) or more separate pieces of tubing or other material connected together. Front stand 30 can be widened and first section 34 can flare outward if greater stability is needed or desired. Similarly, rear stand 32 and fourth section 40 can flare outward if greater stability is needed or necessary.

Tube 20, and preferably the second section 36, comprises fulcrum 42 for pivotably supporting second linkages 28 and the optional resistance or assistance mechanism 18, as disclosed in more detail herein. High strength non-brittle materials are preferred for the base 12, such as metals, carbon fiber composites, and certain plastics.

A simple embodiment of stands 30, 32 are planar pieces of material to which tubes 20 are attached. Stands 30, 32 can be any size or shape so long as stands 30, 32 are sufficiently sized and shaped to stably support machine 10 with a user U during an exercise regimen. Front stand 30 further comprises means for attaching arm levers 16 to front stand, such as front flanges 46. There can be one (1) or two (2) front flanges 46 for supporting each arm lever 16, with two (2) being shown in the figures for each arm lever 16. In the embodiments shown in the figures, front flanges 46 are located outside where base 12 attaches to front stand 30. However, depending on the structure of base 12 and the size of front stand 30, front flanges can be located inside where base 12 attaches to front stand, such as, for example, in a configuration where front stand 30 is widened and first section 34 flares outward.

Arm lever 16 is a rod or tubular member of any desired cross-sectional shape, with circular being the most common. As shown in FIG. 1, arm lever 16 has an "S" or "Z" longitudinal shape comprising three (3) sections, with each section being approximately the same length. This shape allows for the first linkage 26 to be longer and/or of a more desirable size, as discussed in more detail herein, when compared to a linear shape of arm lever 16. An arc shape also can be suitable for arm lever 16. Arm lever 16 further comprises a connection flange 52 via which the first linkage 26 can be pivotably or rotatably attached to the arm lever 16, either directly or by using journal rod 54, as disclosed in more detail herein.

As shown in FIGS. 2 and 3, arm lever 16 can comprise several components so as to be adjustable. In this embodiment, arm lever 16 comprises two (2) rod or tubular sections 56, 58, two (2) adjustment plates 60, and an adjustment pin 62 that cooperates with adjustment holes 64 on adjustment plates 60. First tubular section 56 is a generally straight component, optionally having a non-straight upper end, that is, pivotably attached to the front stand 30 at a lower end and preferably rigidly attached to the adjustment plates 60 on the upper end. For example, first tubular section 56 can be sandwiched between adjustment plates 60. Second tubular section 58 is a component having a bend approximately midway along its length so as to form a shallow "V" shaped component that is pivotably attached to the adjustment plates 60. For example, a lower end of second tubular section 58 can be pivotably attached to adjustment plates 60 via a pivot point or means, such as a pin extending between adjustment plates 60 through a pivot hole 66 through a lower end of second tubular section 58. Second tubular section 58 further comprises a pin hole 68 for cooperating with adjustment holes 64 and adjustment pin 62. For example, second tubular section 58 can be rotated about pivot point, namely pivot hole 66, so as to align pin hole 68 with one of the adjustment holes 64, and adjustment pin 62 can be inserted through adjustment holes and pin hole 68 to hold second tubular section 58 at a desired position and angle. Second tubular section 58 therefore can be adjusted closer or farther from a user U for comfort and to accommodate different size users U.

Arm lever 16 is pivotably attached to front stand 30 via the front flanges 46 such that arm lever 16 can rotate or pivot forwards and backwards. For example, arm lever 16 can have holes 48 formed near the lower end, which holes 48 can cooperate with holes 50 through front flange 46. A pivot axle rod with cotter pins (not shown) or the equivalent can be used to pivotably secure arm lever 16 to front flange 46.

User platform 14 is a generally planar structure on which a user U kneels, or which otherwise supports a user U, during the exercise regimen when using the machine 10. User platform 14 can be a simple rectangular structure similar to the seat of a chair or a flat board, or can be a more complex structure such as the shaped structure shown in the figures comprising knee and lower legs troughs 70. Troughs 70 provide a number of advantages. First, troughs 70 can maintain a user's U legs in a preferred configuration for using the machine 10. Second, troughs 70 can maintain a user's legs in a position such that user's toes or feet do not contact base 12. Third, troughs 70 can provide for a more comfortable user U experience by better securing a user's legs on the user platform 14. Fourth, troughs 70 can provide for the friction or pressure necessary or desired for a user U to be able to rotate the user platform 14 in preparation for or during the exercise regimen, as disclosed herein. User platform 14 optionally can have padding (not shown) thereon for the additional comfort of a user U. User platform 14 preferably is of a size, shape, and strength to comfortably or at least adequately support a user U thereon. Two embodiments of user platform 14 are shown in FIG. 1, the upper embodiment not comprising a rotation bearing support plate 72 and the lower embodiment comprising a rotation bearing support plate 72. These two embodiments of user platform 14 are interchangeable and each can be used with the machine 10.

The embodiment of the user platform 14 not having a rotation bearing support plate 72 comprises bearings or wheels 74 attached to the bottom of the user platform 14. Wheels 74 are rotatably mounted on a wheel support 76, with wheel support 76 preferably pivotably mounted to a bearing support 78, with bearing support 78 preferably being securely mounted to the bottom of user platform 14. Preferably, there are two (2) sets of two (2) wheels 74 extending downwardly from the bottom of user platform 14. Wheels 74 cooperate with base 12, preferably the third section 38 of base 12, so that user platform 14 is slidably mounted on the base 12, and preferably slidably mounted on the third section 38 of base 12. Wheels 74 are rotatably mounted on bearing support 76 in a generally vertical manner such that a top wheel 74A is located above base 12 and a bottom wheel 74B is located below base 12, with base 12 being located between wheels 74A, 74B. In this manner, user platform 14 is effectively secured onto base 12 in a slidable manner. Bearing support 78 preferably is pivotably mounted to wheel support 76 such that bearing support 78, and therefore user platform 14, can pivot or rotate upwards and downwards relative to wheel support 74. Additionally, bearing supports 76 are preferably located on the back end 22 of user platform 14 such that front end 80 of user platform 14 can pivot or rotate upwards and downwards relative to back end 22 of user platform 14, with the axis of pivot or rotation being horizontally through the pivotal connection between wheel support 76 and bearing support 78.

The embodiment of the user platform 14 not having a rotation bearing support plate 72 also comprises at least one (1) connection flange 82 attached to the bottom of the user platform 14. Connection flange 84 rotatably or pivotably connects user platform 14 to the second end of second linkage 28. In this manner, while the back end 22 of user platform 14 is supported on the base 12 by the wheels 74, the front end 80 of user platform 14 is supported by the second linkage 28 such that the front end 80 of user platform 14 preferably does not contact the base 12. The machine 10 also can comprise a support bar (not shown) underneath base 12, preferably underneath second part 36 or third part 38, that will support second linkage 28 and act as a stop especially while trying to adjust linkage pivot 102. The linkage mechanism 24 operatively connects or links the arm levers 16 to the user platform 14 in a manner disclosed herein such that the activation of the machine 10 by pulling and pushing on the arm levers 14 causes the user platform 14 to slide and pivot in the manner disclosed herein.

The user platform 14 also can be adjustable in slope. For example, an adjustment mechanism (not shown) can be incorporated between the user platform 14 and the bearing support 78, between the user platform 14 and the rotation bearing support plate 72, or between the rotation bearing support plate 72 and the bearing support 78. Such an adjustment mechanism can allow the back end 22 of user platform 14 to be raised or lowered relative to bearing support 78 or raised or lowered relative to rotation bearing support plate 72, or can allow the back end 86 of rotation bearing support plate 14 to be raised or lowered relative to bearing support 78. By adjusting the initial slope of the user platform 14, the user U can adjust the machine 10 for comfort or for the initial angle between the hips and torso of a user U so as to adjust the action of the machine 10 for more or less range of motion of the abdominal muscles of a user U.

The machine 10 also can include a rotation bearing support plate 72 on which the user platform 14 is rotatably mounted. The rotation bearing support plate 72 can provide for free rotation of the user platform 14 or angled placement of the user platform 14. For example, a rotation bearing 92 is used to rotatably connect user platform 14 to rotation bearing support plate 72. In this manner, the user platform 14 is rotatably mounted on the rotation bearing support plate 72, and the rotation bearing support plate 72 is slidably and pivotably mounted on the base 12.

The embodiment of the user platform 14 having a rotation bearing support plate 72 comprises bearings or wheels 74 attached to the bottom of the rotation bearing support plate 72 rather than to the bottom of user platform 14. In a construction similar to that disclosed above, wheels 74 are mounted on a wheel support 76, with wheel support preferably pivotably mounted to bearing support 78, with bearing support 78 preferably being securely mounted to the bottom of rotation bearing support plate 72. Preferably, there are two (2) sets of two (2) wheels 74 extending downwardly from the bottom of rotation bearing support plate 72. Wheels 74 cooperate with base 12, preferably the third section 38 of base 12, so that rotation bearing support plate 72 is slidably mounted on the base 12, and preferably slidably mounted on the third section 38 of base 12. Wheels 74 are rotatably mounted on bearing support 76 in a generally vertical manner such that a top wheel 74A is located above base 12 and a bottom wheel 74B is located below base, with base 12 being located between wheels 74A, 74B. In this manner, rotation bearing support plate 72 is effectively secured onto base 12 in a slidable manner. Bearing support 78 preferably is pivotably mounted to wheel support 76 such that bearing support 78, and therefore rotation bearing support plate 72, can pivot or rotate upwards and downwards relative to wheel support 76. Additionally, bearing supports 78 are preferably located on the back end 86 of rotation bearing support plate 72 such that front end 84 of rotation bearing support plate 72 can pivot or rotate upwards and downwards relative to back end 86 of rotation bearing support plate 72, with the axis of pivot or rotation being horizontally through the pivotal connection between wheel support 76 and bearing support 78. As user platform 14 is rotatably secured to rotation bearing support plate 72, user platform 14 pivots or rotates upwards and downwards along with rotation bearing support plate 72.

The embodiment of the user platform 14 having a rotation bearing support plate 72 also comprises at least one (1) connection flange 82 attached to the bottom of the front end 84 of the rotation bearing support plate 72. Connection flange 82 rotatably connects rotation bearing support plate 72 to the second end of second linkage 28. In this manner, while the back end 86 of rotation bearing support plate 72 is supported on the base 12 by the wheels 74, the front end 84 of rotation bearing support plate 72 is supported by the second linkage 28 such that the front end 84 of rotation bearing support plate 72 preferably does not contact the base 12. The linkage mechanism 24 operatively connects or links the arm levers 16 to the rotation bearing support plate 72 in a manner disclosed herein such that the activation of the machine 10 by pulling and pushing on the arm levers 14 causes the rotation bearing support plate 72 and therefore the user platform 14, to slide and pivot or rotate in the manner disclosed herein.

The embodiment of the user platform 14 having a rotation bearing support plate 72 also comprises, optionally but preferably, a locking/unlocking mechanism comprising a locking lever and pin 88 and locking holes 90 that allow the user platform 14 to be unlocked and rotated relative to the rotation bearing support plate 72 such that the user platform 14 can be set at a desired angle relative to the rotation bearing support plate 72 and locked at that angle. While the rotation bearing support plate 72 is in motion or stationary, the user platform 14 can be rotated relative to the rotation platform 72. Locking lever and pin 88 and locking holes 90 operate in a conventional manner such that, for example, locking lever and pin 88 can be withdrawn from a locking hole 90, user platform 14 rotated relative to rotation bearing support plate 72 to a desired position, and locking lever and pin 88 inserted into the proximal locking hole 90 to secure user platform 14 in the desired position. Locking lever and pin 88 can be spring-loaded so as to remain in the locked position. Alternatively, the locking lever and pin 88 can be left in the unlocked position, or the locking lever and pin 88 and locking holes 90 can be eliminated, such that the user platform 14 is freely rotatable during the exercise regimen, so as to allow the user U to rotate his or her torso during the exercise regimen.

Figure 5:
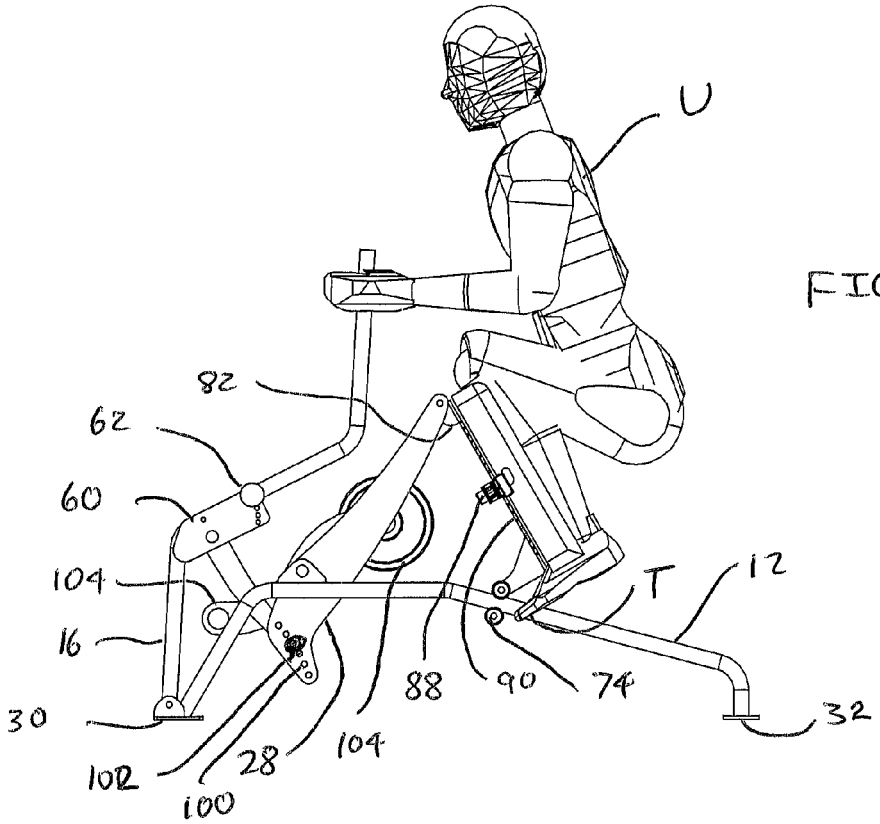
FIG. 5 is a side view of the third embodiment of the invention in the activated position showing adjustable arm levers and an adjustable linkage mechanism with a weight on a rear weight peg.

In both embodiments with and without rotation bearing support plate 72, bearing support 78 can be configured to be of a shape and/or height that will hold user platform 14 high enough above base 12 such that a user's toes T or feet will not contact base 12 during the exercise regimen. Although FIG. 5 shows a user's toes T extending next to and possibly slightly below tube 12, the shape and/or height of bearing support 78 can be chosen to prevent this.

The linkage mechanism 24 operatively connects or links the arm levers 16 to either the user platform 14 or the rotation bearing support plate 72 in a manner such that the activation of the machine by pulling and pushing (pivoting backwards and forwards) on the arm levers 16 causes the user platform 14 or the combination of the user platform 14 and the rotation bearing support plate 72 to slide and pivot in the manner disclosed herein. One embodiment of linkage mechanism 24 comprises first linkage 26 having a first end 26A and a second end 26B and a second linkage 28 having a first end 28A and a second end 28B. First linkage 26 can be in the structure of a connecting arm having connecting means, such as holes, bearings, bushings, pins, or the like on the first and second ends 26A, 26B. In one embodiment, first linkage 26 does not bear weight and needs to have only the tensile and compressive strength to transmit the force applied to arm lever 16 to second linkage 28, and vice versa. Second linkage 28 can be in the structure of a connecting arm but more preferably has a stronger structure such as the shaped flat panel shown in the figures. Second linkage has connecting means, such as holes, bearings, bushings, pins, or the like on the first and second ends 28A, 28*b*, and also has a pivot connection 94 for pivotally attaching the second linkage 28 to the base 12. In one embodiment, second linkage 28 bears the weight of the user platform 14, or the user platform 14 and the rotation bearing support plate 72, and therefore second linkage 28 needs to have additional structure and/or strength so as to both transmit the force applied to arm lever 16 to the user platform 14 or to the rotation bearing support plate 72, and vice versa, and to bear at least part of the weight of the user platform 14, the user U, and the rotation bearing support plate 72, if and when present.

The embodiment of the linkage mechanism 24 shown in the figures comprises at least one first linkage 26 and at least one second linkage 28. The first linkage 26 is connected at a first end 26A to or operatively proximal to arm lever 16 and is connected at a second end 26B to a first end 28A of the second linkage 28. The second linkage 28 is connected at a first end 28A to the second end 26B of the first linkage 26 and is connected at a second end 28B to or operatively proximal to the user platform 14 or to the rotation bearing support plate 72, and preferably to a front end 80 of the user platform 14 or to a front end 84 of the rotation bearing support plate 72. The linkage mechanism 24 connects the arm levers 16 to the user platform 14, either directly or via the rotation bearing support plate 72, in such a manner that when the arm levers 16 are pulled towards the user U, and thus towards the user platform 14, the linkages 26, 28 are caused to move so as to move the user platform 14, and thus the user U, towards the arm levers 16.

As shown in FIG. 3, first linkage 26 and second linage 28 can be adjustably connected to each other. For example, second end 26B of first linkage 26 can be pivotably attached to first end 28A of second linkage 28 at one of a plurality of adjustment holes 100 via a pivot linkage 102 or other linkage means, such as a pin extending between the second end 26B of first linkage 26 through an adjustment hole 100 on second linkage 28. In this manner, pivot linkage 102 can be positioned so as to align with one of the adjustment holes 100, and pivot linkage 102 can be inserted through the selected adjustment hole 100 to pivotably secure first linkage 26 to second linkage 28 at a desired position. As with the adjustable connection between first linkage 26 and arm lever 16 disclosed herein, the adjustable connection between first linkage 26 and second linkage 28 can provide both for a more suitable exercise regimen for user U by providing for a variable mechanical advantage based on the initial angle of connection between first linkage 26 and second linkage 28 and the distance between the connection point between first linkage 26 and second linkage 28 and the pivot point 94.

In one embodiment, first linkage 26 is pivotably mounted directly to arm lever 16, such as by pivotably connecting first end 26A to connection flange 52 via pins, bearings, or the like. In the embodiment shown in FIG. 1, first linkage 26 is pivotably connected to arm lever 16 via journal rod 54. Journal rod 54 can be a solid or tubular rod that extends through journal hole 96 on the first end 26A such that first linkage 26 is pivotally mounted on or hung on journal rod 54. Journal rod 54 then is journaled into or mounted on connection flanges 52 on arm levers 16. In the embodiment shown in FIGS. 2 and 3, first linkage 26 is pivotably connected to arm lever 16 via journal rod 54. Journal rod 54 is journaled into or mounted on adjustment plates 60, such as into rod receiver 98, which is one or more holes or other connections on adjustment plates 60 structured to receive and hold and support journal rod 54. The use of a journal rod 54 extending between two (2) arm levers 16 has the added advantages of providing extra support or strength to arm levers 16 and helping to maintain arm levers 16 at a suitable distance apart, especially during the exercise regimen.

In one embodiment, the second linkage 28 is pivotably mounted to the base 12 at a location on the base 12 between the arm levers 16 and the user platform 14. The pivot connection 94 on the second lever 28 is located between the first end 28A and the second end 28B of the second linkage 28 such that the second linkage 28 acts as a first class lever mounted on the base 12. Thus, second linkage 28 pivots about pivot connection 94 whereby when first end 28A pivots upwards, second end 28B pivots downwards, and vice versa.

In the embodiment shown in the figures, first linkage 26 is mounted to and between arm lever 16 and second linkage 28 in such a manner that when arm lever 16 is pulled towards the user U, first linkage 26 forces first end 28A of second linkage 28 downwards, causing second linkage 28 to pivot or rotate such that second end 28B rotates upwards. Thus, as can be seen in comparing FIG. 4 to FIG. 5, when the first linkage 26 is caused to move in a downward direction, this forces and rotates or pivots the first end 28A of the second linkage 28 downwards, thus causing the second end 28B of the second linkage 28 to rotate or pivot upwards. As the second end 28B of the second linkage 28 rotates or pivots upwards, the second end 28B of the second linkage 28 also moves in the direction of and closer to the arm levers 16, thus both pulling the user platform 14 forwards and forcing the front end 80 of the user platform 14 upwards, either directly or via the rotation bearing support plate 72. As the back end 22 of the user platform 14, or the back end 86 of the rotation bearing support plate 72, is pivotably and slidably mounted to the base 12, the back end 22 of the user platform 14, or the back end 86 of the rotation bearing support plate 72, remains attached to the base 12, resulting in the user platform 14 angling upwards from back to front, which is in the activated position.

Figure 4:
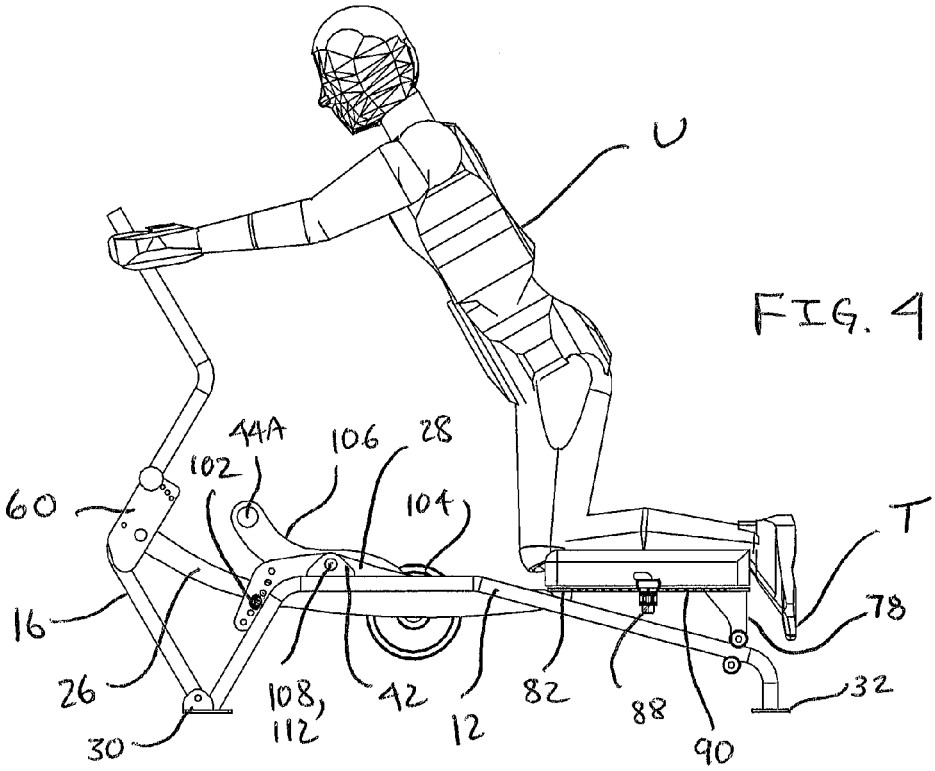
FIG. 4 is a side view of the third embodiment of the invention in the at rest or unactivated position showing adjustable arm levers and an adjustable linkage mechanism with a weight on a rear weight peg.

Similarly, in comparing FIG. 5 to FIG. 4, when the first linkage 26 is caused to move or rotate pivot in an upward direction, this forces or allows and rotates or pivots the first end 28A of the second linkage 28 upwards, thus causing the second end 28B of the second linkage 28 to rotate or pivot downwards. As the second end 28B of the second linkage 28 rotates or pivots downwards, the second end 28B of the second linkage 28 also moves in the direction away from and farther from the arm levers 16, thus both pushing the user platform 14 backwards and forcing the front end 80 of the user platform 16 downwards, either directly or via the rotation bearing support plate 72.

As the back end 22 of the user platform 14, or the back end 86 of the rotation bearing support plate 72, is pivotably and slidably mounted to the base 12, the back end 22 of the user platform 14, or the back end 86 of the rotation bearing support plate 72, remains attached to the base 12, resulting in the user platform 14 being horizontal, generally horizontal, or have a slight slope from back to front, which is in the at rest or inactivated or starting position.

If the optional resistance or assistance mechanism 18 is included, the linkage mechanism 24 also operatively connects the resistance or assistance mechanism 18 to the arm levers 16 and/or the user platform 14 or the rotation bearing support plate 72. The optional resistance or assistance mechanism 18 can be mounted on the machine 10 at various alternative locations so long as the resistance or assistance mechanism 18 is operatively connected to the machine 10 so as to impart additional weight resistance or assistance to the user U during the exercise regimen. One embodiment of a preferred resistance or assistance mechanism 18 is the weight bar 106 and free weights 104 shown in the figures.

In one embodiment as shown in FIGS. 4 and 5, the resistance or assistance mechanism 18 is mounted to the second linkage 28 and operatively connected to the base 12 such that when the second linkage 28 is moved during the exercise regimen, the resistance or assistance mechanism 18 moves as well. The resistance and assistance mechanism 18 comprises weight bar 106, weight pegs 44A, 44B extending from weight bar 106, free weights 104 to place on weight pegs 44A, 44B, and support rod 108 for attaching weight bar 106 to second linkage 28 and for pivotally supporting second linkage 28 and resistance or assistance mechanism 18 on base 12 via fulcrum 42. Weight bar 106 is securely mounted to support rod 108, which in turn is securely mounted to and through second linkage 28, for example by passing support rod 108 through rod holes 110 in second linkage 28 and welding or otherwise securely attaching support rod 108 to second linkage 28. A portion 112 of support rod 108 should extend through rod holes 110 after support rod 108 is attached to second linkage 28. Rod portion 112 then can be inserted into a hole through fulcrum 42 to pivotably or rotatably mount the combination of second linkage 28 and resistance or assistance mechanism 18 to base 12. In this configuration, as second linkage 28 pivots or rotates, resistance or assistance mechanism 18 will pivot or rotate with second linkage 28.

Weights 104 can be placed on either weight peg 44A, 44B. If weights 104 are placed on front weight peg 44A, then this will assist user U when conducting the first half of the exercise and resist user U when conducting the second half of the exercise, as weight 104 on front weight peg 44A will assist in lifting the second end 28A of second linkage 28 and will resist in lowering the second end 28A of second linkage 28, respectively. If weights 104 are placed on back weight peg 44B, then this will resist user U when conducting the first half of the exercise and assist user U when conducting the second half of the exercise, as weight 104 on back weight peg 44B will resist in lifting the second end 28B of second linkage 28 and will assist in lowering the second end 28B of second linkage 28, respectively.

In another embodiment, the resistance or assistance mechanism 18 is pivotably mounted to the base 12 and is operatively connected to the second linkage 28 such that when the second linkage 28 is moved during the exercise regimen, the resistance or assistance mechanism 18 acts upon the second linkage 28. In this embodiment, the back weight peg 44B acts as a stop and extends from weight bar 106 a distance such that weight peg 44B can interfere with the movement of weight bar 106 by contacting the bottom of the second end 28A of second linkage 28. More specifically, back weight peg 44B should have a length so that back weight peg 44B extends underneath second end 28A of second linkage 28, but not so far that back weight peg 44B extends underneath base 12. In this embodiment, weight bar 106 is securely mounted to support rod 108, which in turn is pivotably or rotatably mounted to and through second linkage 28, for example by passing support rod 108 through rod holes 110 in second linkage 28 and not welding or not securely attaching support rod 108 to second linkage 28. A portion 112 of support rod 108 also should extend through rod holes 110. Rod portion 112 then can be inserted into a hole through fulcrum 42 to pivotably or rotatably mount the combination of second linkage 28 and resistance or assistance mechanism 18 to base 12. In this configuration, as second linkage 28 is pivotably or rotatably mounted on support rod 108 and when second linkage 28 pivots or rotates, resistance or assistance mechanism 18 will not necessarily pivot or rotate with second linkage 28.

Weights 104 can be placed on front weight peg 44A, and the weight of weights 104 will cause the front end of weight bar 106, that is the end of weight bar 106 carrying front weight peg 44A and weights 104, to rotate downwards. After weight bar 106 rotates a certain distance, rear weight peg 44B, due to its length, will contact the bottom side or edge of the second end 28B of second linkage 28, thus effectively stopping weight bar 106 from rotating further. The weight of weights 104 thus is transferred via weight bar 106 to back weight peg 44B and to second linkage 28. In this embodiment, weights 104 will assist user U when conducting the first half of the exercise and resist user U when conducting the second half of the exercise, as weight 104 on front weight peg 44A will assist in lifting the second end 28B of second linkage 28 and will resist in lowering the second end 28B of second linkage 28, respectively.

In yet another embodiment, the resistance or assistance mechanism 18 connects second linkage 28 to base 12. One example of this embodiment is an elastic device attached to or looped around the second end 28B and also attached to or looped around base 12. As second end 28B is moved upwards upon the pulling of arm lever 16, the elastic would be stretched between the second end 28B and the base 12, thus producing elastic resistance. Another example of this embodiment is a hydraulic or pneumatic cylinder or device attached to the second end 28B and also attached to base 12. As second end 28B is moved upwards upon the pulling of arm lever 16, the piston would be pulled in the barrel, thus producing hydraulic or pneumatic resistance. Another example of this embodiment is a spring attached to the second end 28B and also attached to base 12. As second end 28B is moved upwards upon the pulling of arm lever 16, the spring would be stretched, thus producing tension. The resistance or assistance mechanism 18 could be movable between a position proximal to fulcrum 42 and a position proximal to the end of second end 28B proximal to connection flange 82 so as to change the amount of resistance. Other alternate resistance or assistance mechanisms 18 can be used in a similar or equivalent manner.

The degree of weight resistance of the resistance or assistance mechanism 18 can be controlled by the user U. For example, if the resistance or assistance mechanism 18 comprises a free weight bar 44A, 44B, additional weights 100 can be added to or removed from the weight bar 44A, 44B in a conventional manner. For another example, additional elastics or springs can be attached between second end 28B of second linkage 28 and base 12. Other resistance or assistance mechanisms can be used in their conventional manners.

Referring now to FIGS. 4 and 5, side views of the third representative embodiment of the invention is shown with adjustable arm levers and an adjustable linkage mechanism and illustrating the placement of a weight 104 on a rear weight peg 44B. FIG. 4 shows the third embodiment in the at rest or unactivated position. FIG. 5 shows the third embodiment of the invention in the activated position. A comparison of FIGS. 4 and 5 illustrates in more detail the location of the arm lever 16 relative to the user platform 14, the position and angle of the user platform 14, and the position and action of the resistance or assistance mechanism 18 in the at rest or inactivated (initial or starting) position shown in FIG. 4 and the fully activated position shown in FIG. 5.

As can be seen in FIGS. 4 and 5, and generally in FIGS. 6-43, the linkage mechanism 24 and the resistance or assistance mechanism 18 is located almost entirely within the footprint of the base 12, namely between tubes 12 and stands 30, 32, with only a portion of the first linkage 26 possibly extending forward of front stand 30. This allows for a more compact design.

Referring now to FIGS. 6-43, various perspective views of several embodiments of the machine 10 are shown to provide a more complete understanding of the invention. FIGS. 6-17 are perspective views of the first embodiment comprising a weight bar 106 resistance and assistance mechanism 18 with a weight 104 shown on a front weight peg 44A. FIGS. 18-25 are perspective views of the second embodiment comprising a weight bar 106 resistance and assistance mechanism 18 with a weight 104 shown on a front weight peg 44A. FIGS. 26-37 are perspective views of the second embodiment comprising a weight bar 106 resistance and assistance mechanism 18 with a weight 104 shown on a back weight peg 44B. FIGS. 38-43 are perspective views of the third embodiment comprising a weight bar 106 resistance and assistance mechanism 18 with a weight 104 shown on a back weight peg 44B.

Figure 6:
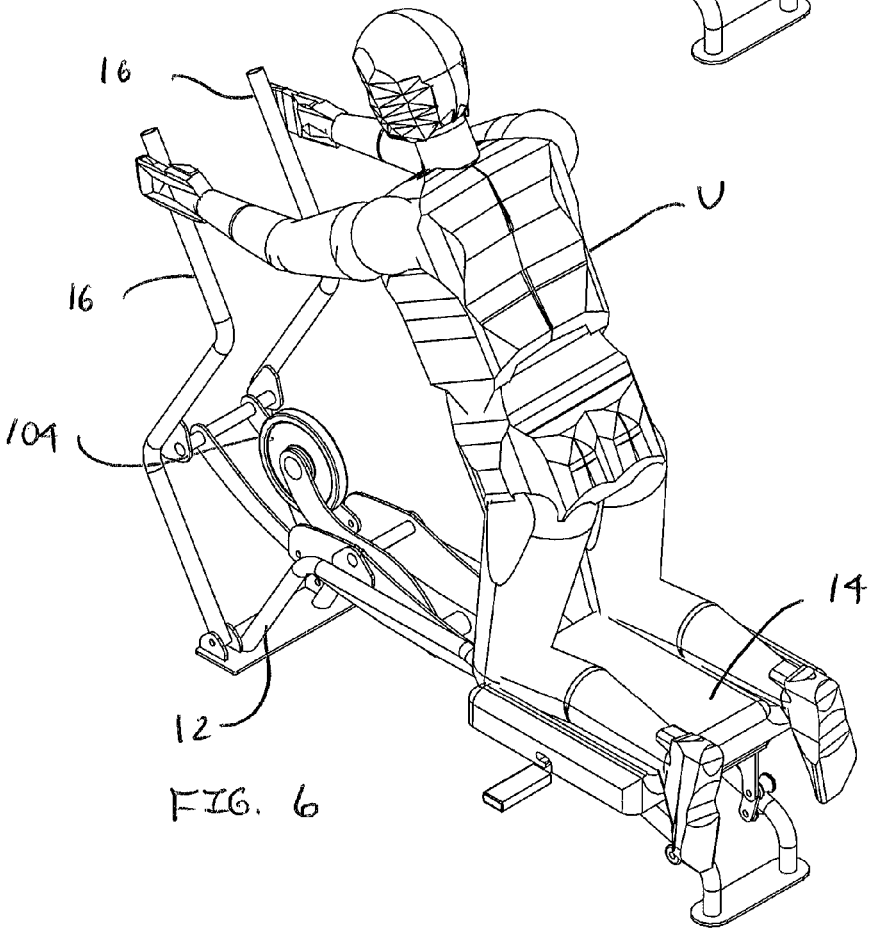
FIG. 6 is a left rear perspective view of the first embodiment of the invention in the at rest or unactivated position.
Figure 7:
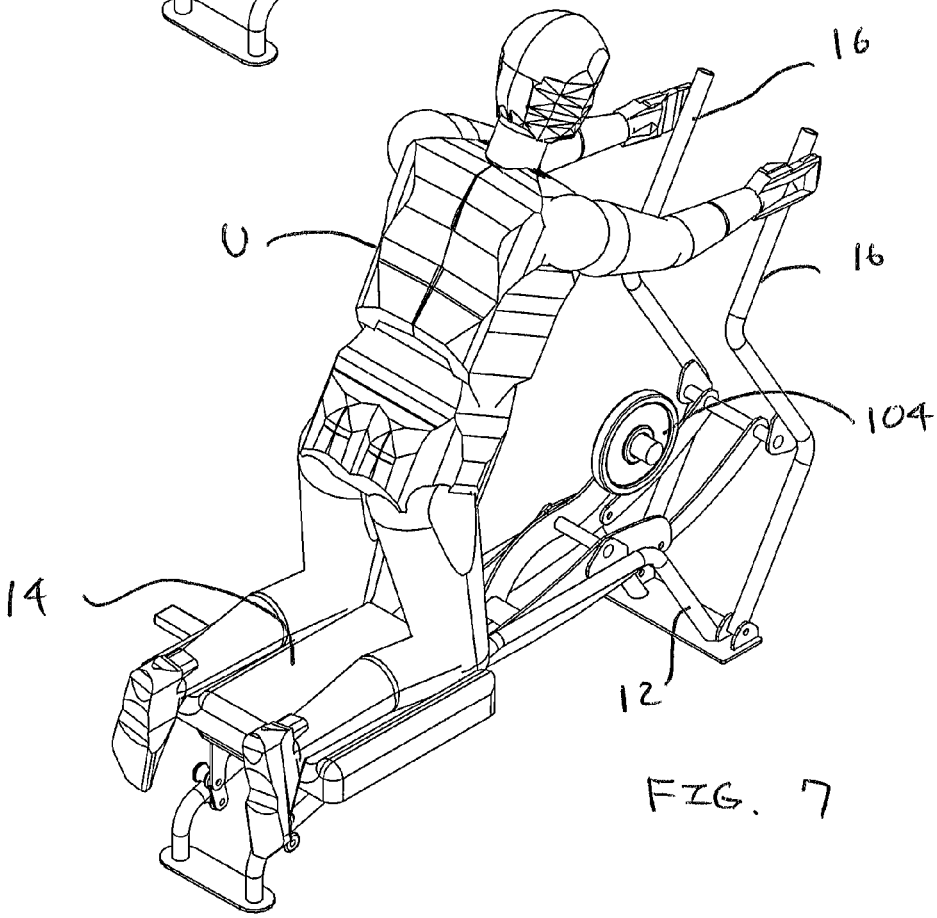
FIG. 7 is a right rear perspective view of the first embodiment of the invention in the at rest or unactivated position.
Figure 8:
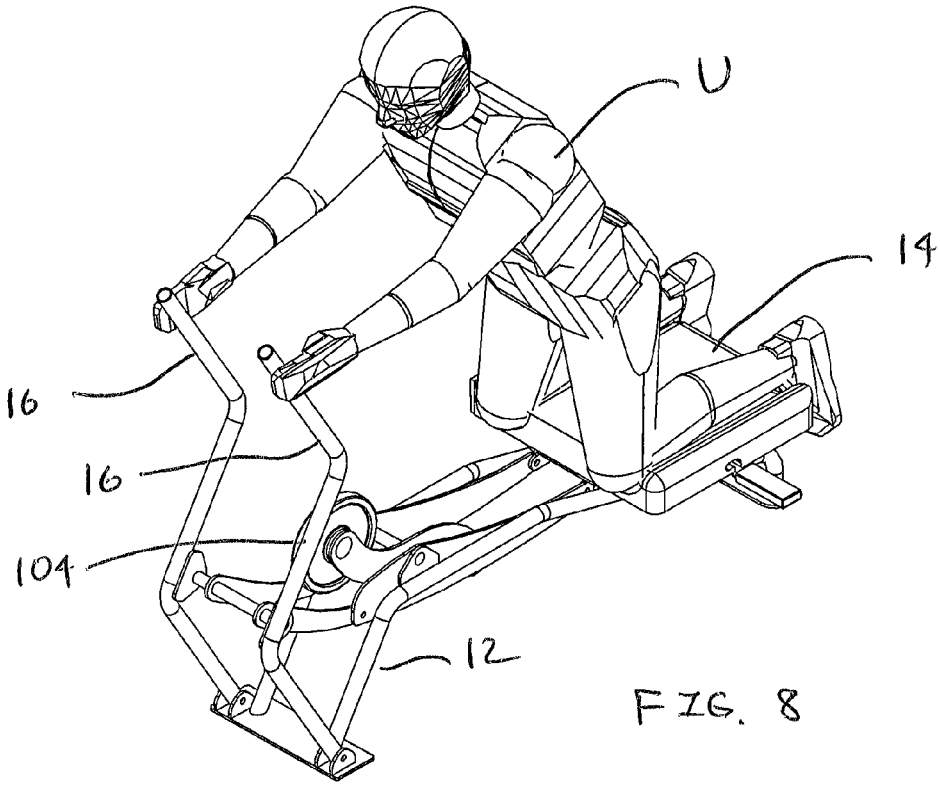
FIG. 8 is a left front perspective view of the first embodiment of the invention in the at rest or unactivated position.

Referring now to FIGS. 6-8, perspective views of the first embodiment are shown in the at rest or unactivated position. User U is kneeling on the user platform 14 and is grasping arm levers 16. User platform 14 is shown in the at rest position towards the back of the base 12 and in a generally horizontal position. Arm levers 16 are shown in the at rest position towards the front of the base 12. Weight 104 is shown in a first raised position. The user's U has not contracted the user's abdominal muscles to start the exercise regimen. The user's arms are in an extended position away from the user's chest.

Figure 9:
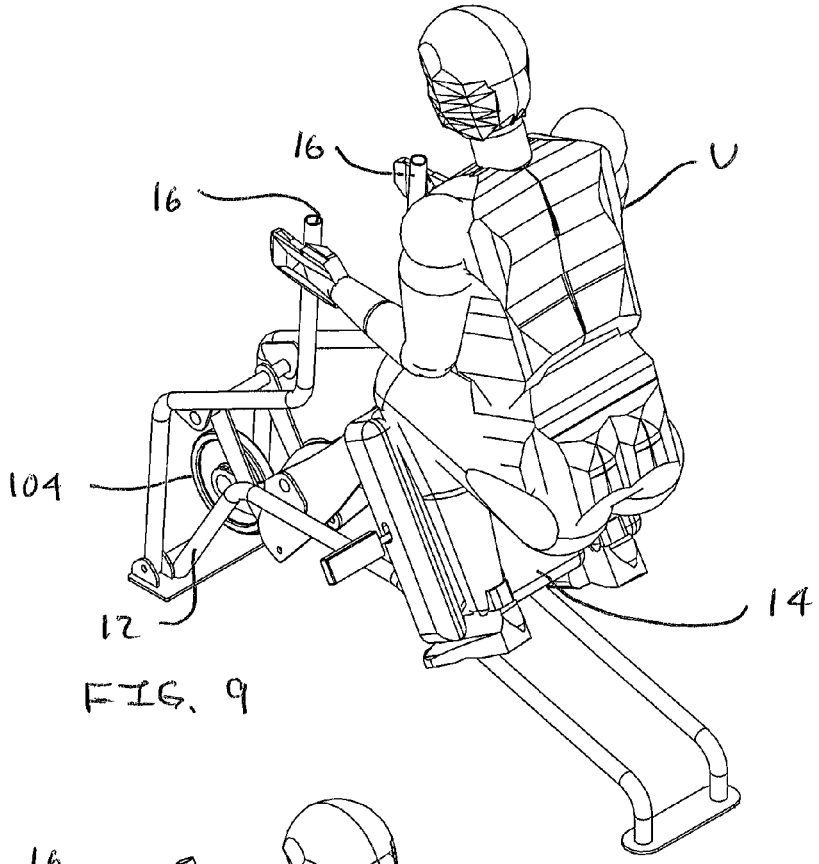
FIG. 9 is a left rear perspective view of the first embodiment of the invention in the activated position.
Figure 10:
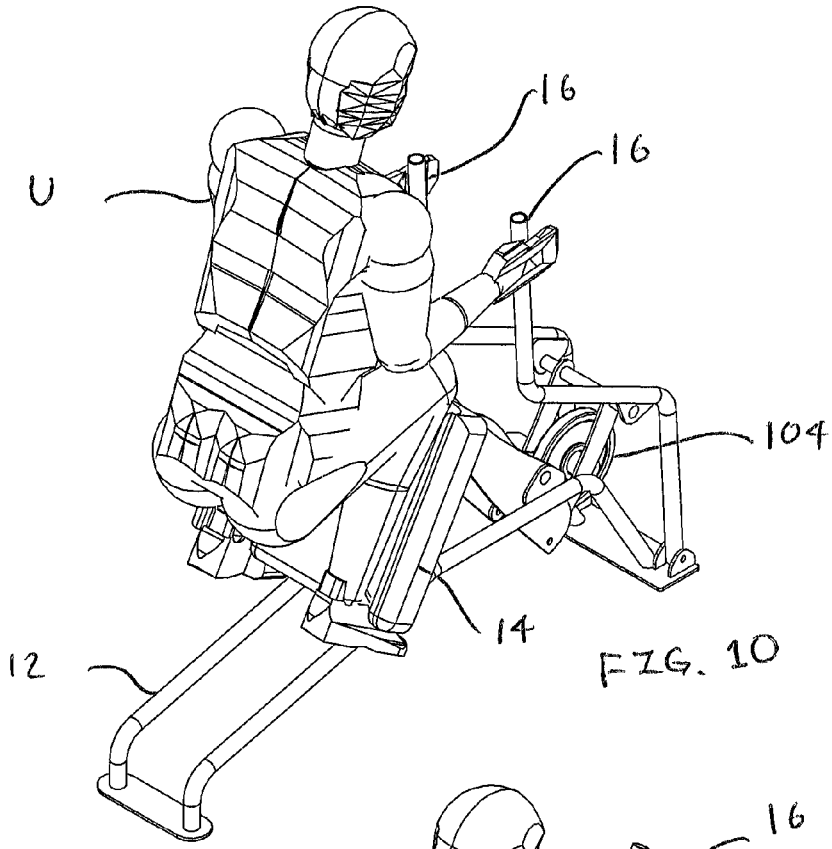
FIG. 10 is a right rear perspective view of the first embodiment of the invention in the activated position.
Figure 11:
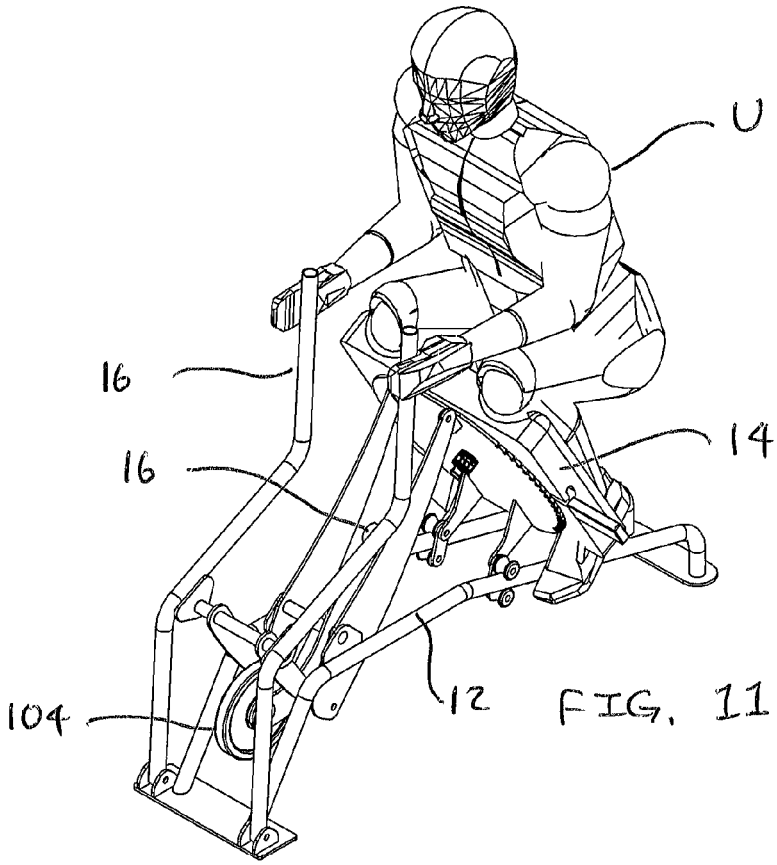
FIG. 11 is a left front perspective view of the first embodiment of the invention in the activated position.

Referring now to FIGS. 9-11, perspective views of the first embodiment are shown in the activated position. User U is still kneeling on the user platform 14 and is still grasping arm levers 16. User platform 14 is shown in the activated position towards the middle of the base 12 and in an angled position. Arm levers 16 are shown in the activated position towards the middle of the base 12. Weight 104 is shown in a second lowered position. The user's U has contracted the user's abdominal muscles for start the exercise regimen, and the user's knees are located closer to the user's chest. The user's arms are in a contracted position closer to the user's chest.

Figure 12:
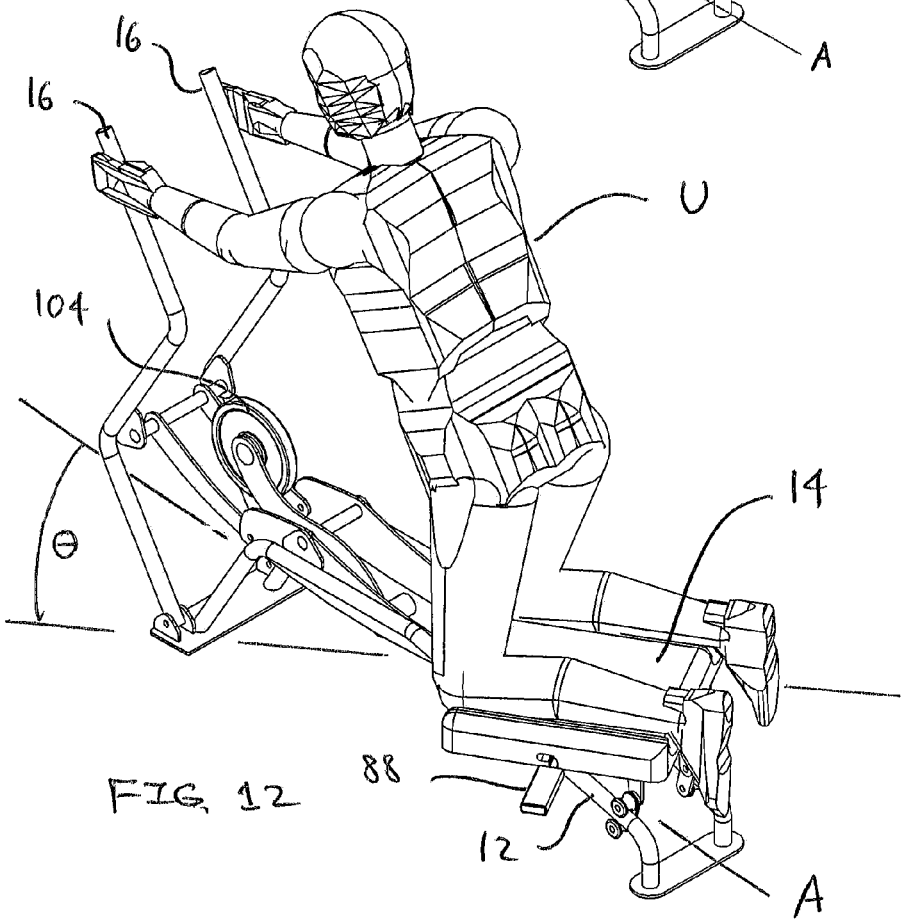
FIG. 12 is a left rear perspective view of the first embodiment of the invention in the at rest or unactivated position illustrating rotation of the user platform.
Figure 13:
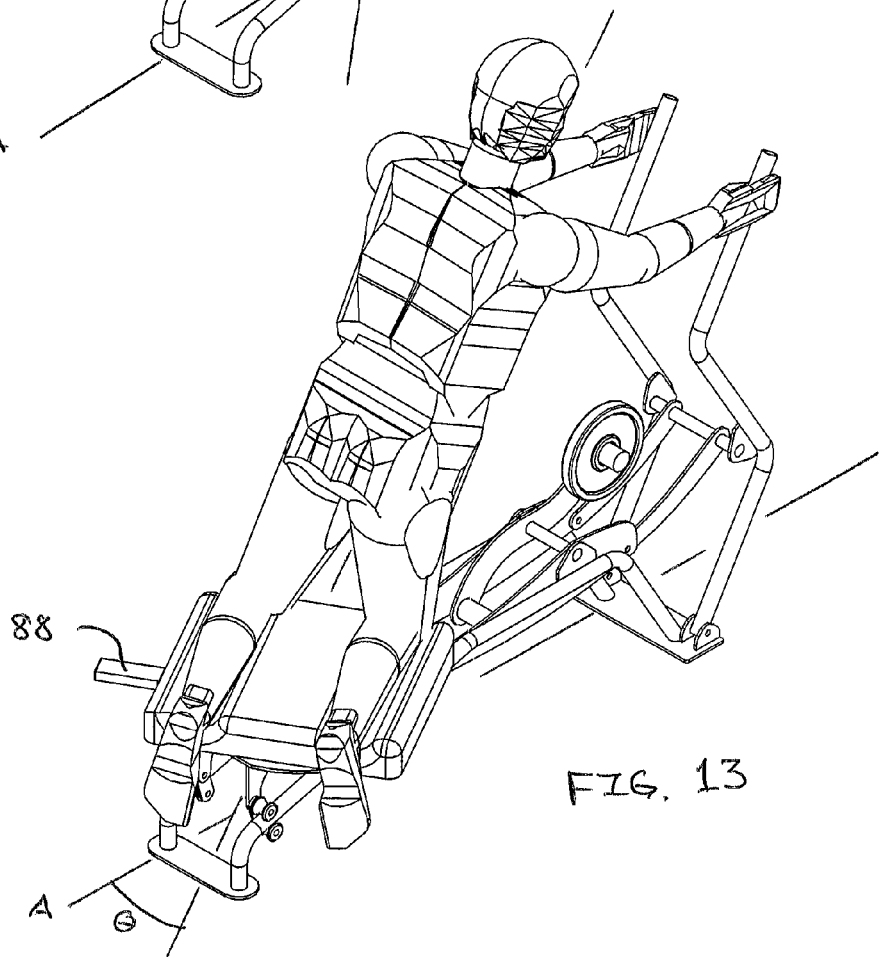
FIG. 13 is a right rear perspective view of the first embodiment of the invention in the at rest or unactivated position illustrating rotation of the user platform.
Figure 14:
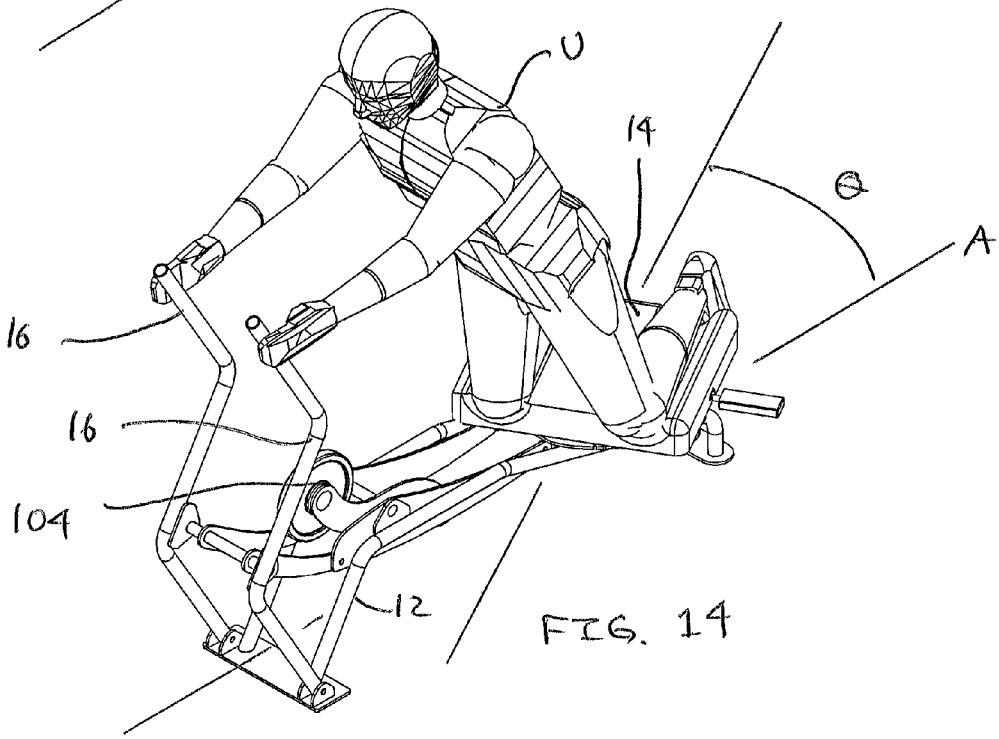
FIG. 14 is a left front perspective view of the first embodiment of the invention in the at rest or unactivated position illustrating rotation of the user platform.

Referring now to FIGS. 12-14, perspective views of the first embodiment are shown in the at rest or unactivated position illustrating rotation of the user platform. User U is kneeling on the user platform 14 and is grasping arm levers 16. User platform 14 is shown in the at rest position towards the back of the base 12 and in a generally horizontal position. However, in these views, user platform 14 is shown rotated so as to be at an angle Θ relative to a linear axis A of base 12 horizontal to the floor and parallel to tubes 20. User platform 14 can be locked in this position using locking lever and pin 88 and locking hole 90 or user platform 14 can be in free rotation controlled by the user U. Arm levers 16 are shown in the at rest position towards the front of the base 12. Weight 104 is shown in a first raised position. The user's U has not contracted the user's abdominal muscles to start the exercise regimen. The user's arms are in an extended position away from the user's chest.

Figure 15:
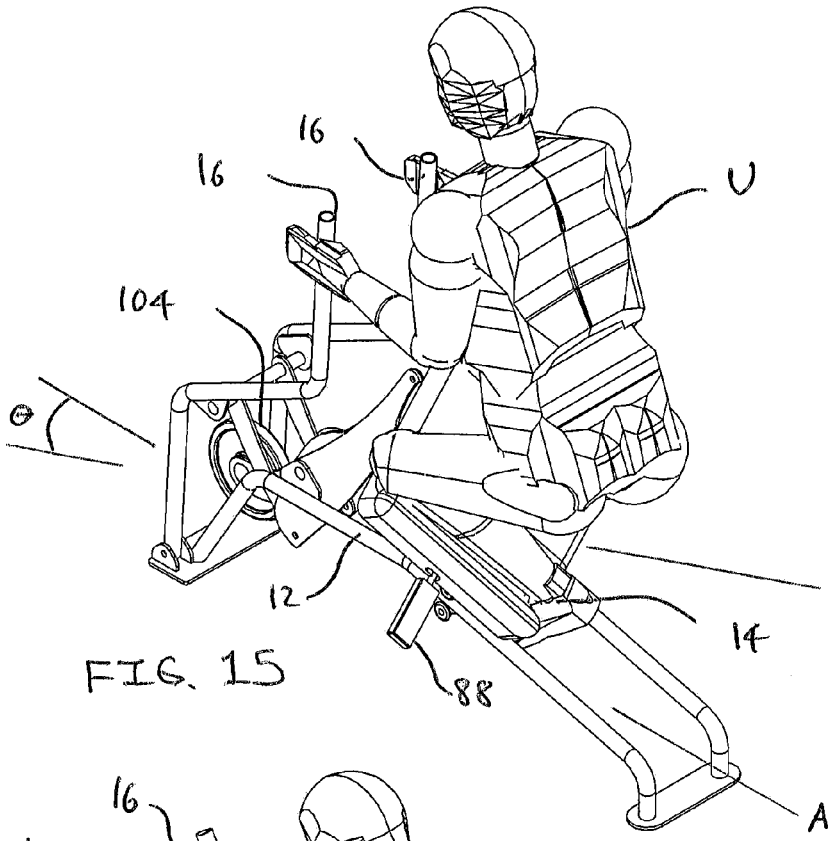
FIG. 15 is a left rear perspective view of the first embodiment of the invention in the activated position illustrating rotation of the user platform.
Figure 16:
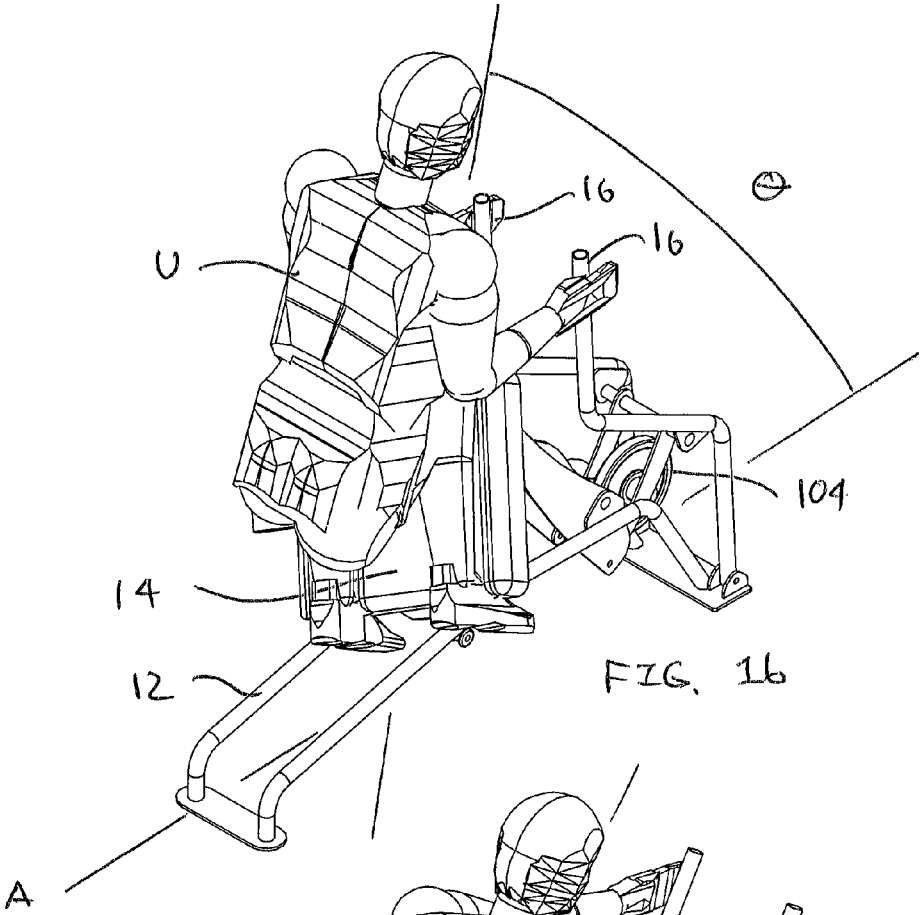
FIG. 16 is a right rear perspective view of the first embodiment of the invention in the activated position illustrating rotation of the user platform.
Figure 17:
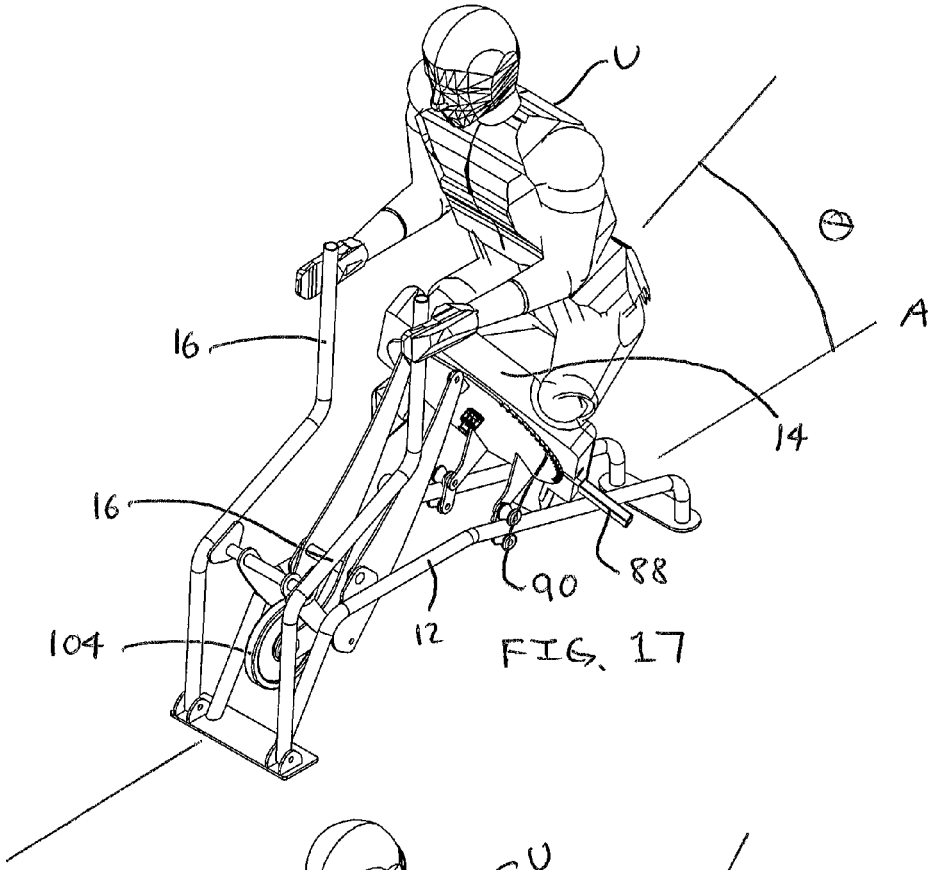
FIG. 17 is a left front perspective view of the first embodiment of the invention in the activated position illustrating rotation of the user platform.

Referring now to FIGS. 15-17, perspective views of the first embodiment are shown in the activated position illustrating rotation of the user platform. User U is still kneeling on the user platform 14 and is still grasping arm levers 16. User platform 14 is shown in the activated position towards the middle of the base 12 and in an angled position. However, in these views, user platform 14 is shown rotated so as to be at an angle Θ relative to a linear axis A of base 12 horizontal to the floor and parallel to tubes 20. User platform 14 can be locked in this position using locking lever and pin 88 and locking hole 90 or user platform 14 can be in free rotation controlled by the user U. Arm levers 16 are shown in the activated position towards the middle of the base 12. Weight 104 is shown in a second lowered position. The user's U has contracted the user's abdominal muscles for start the exercise regimen, and the user's knees are located closer to the user's chest. The user's arms are in a contracted position closer to the user's chest.

Figure 18:
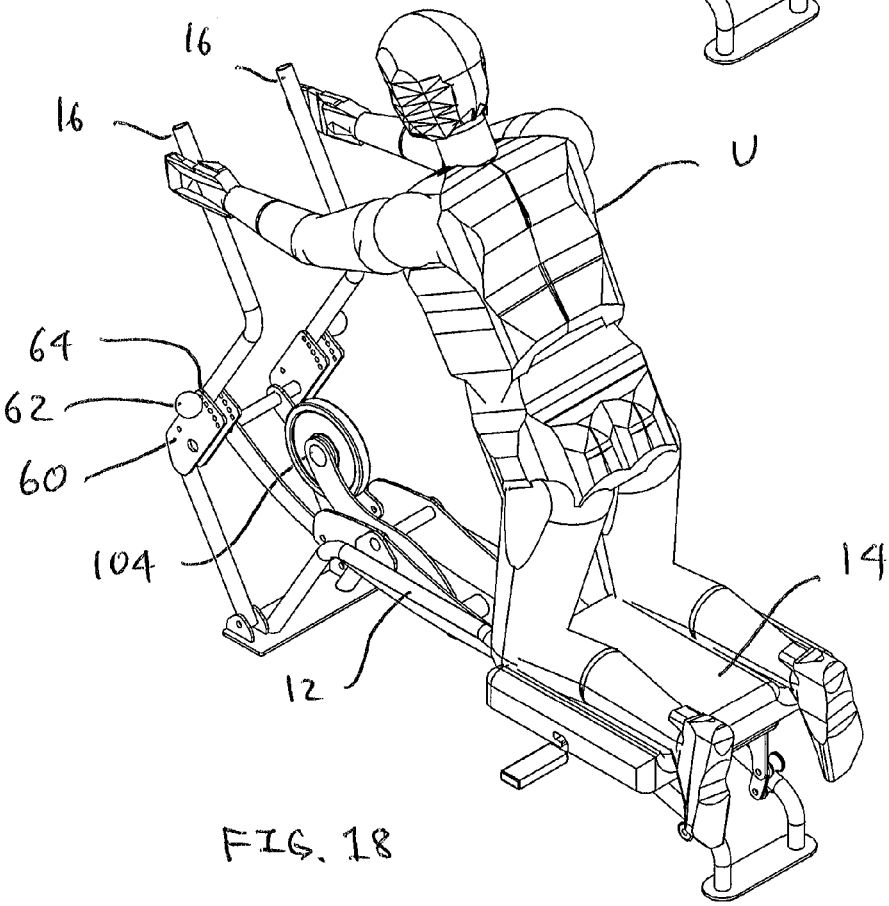
FIG. 18 is a left rear perspective view of a second embodiment of the invention in the at rest or unactivated position illustrating adjustable arm levers.
Figure 19:
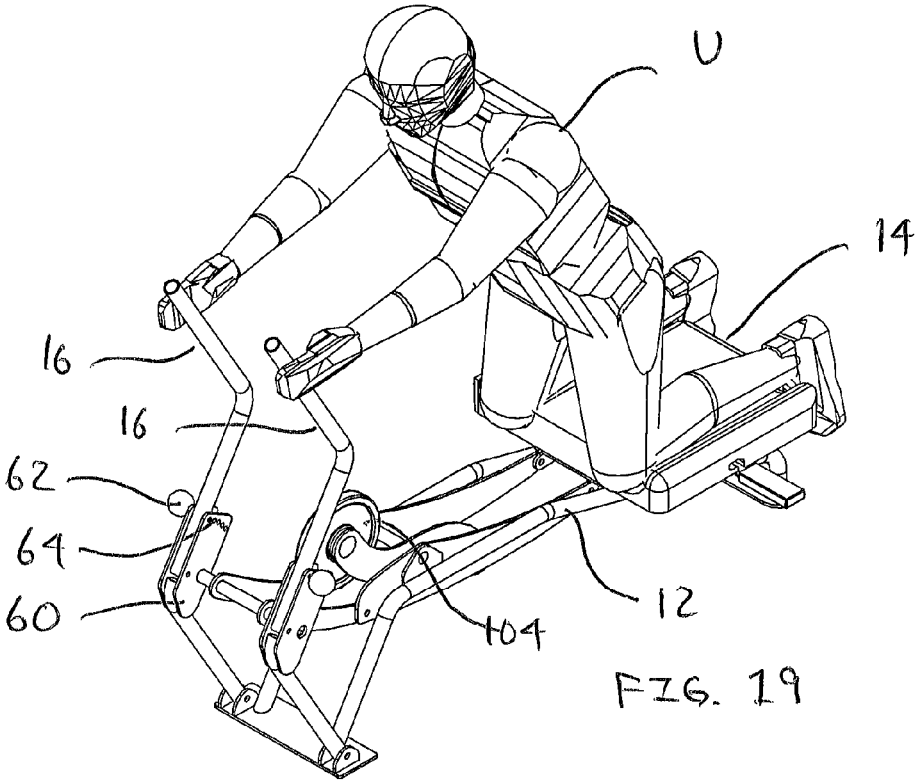
FIG. 19 is a left front perspective view of a second embodiment of the invention in the at rest or unactivated position illustrating adjustable arm levers.

Referring now to FIGS. 18-19, perspective views of the second embodiment are shown in the at rest or unactivated position illustrating adjustable arm levers. User U is kneeling on the user platform 14 and is grasping arm levers 16. User platform 14 is shown in the at rest position towards the back of the base 12 and in a generally horizontal position. Arm levers 16 are shown in the at rest position towards the front of the base 12. Arm levers 14 are shown in a first position relative to adjustment plate 60 as illustrated by the placement of adjustment pin 62 in the first adjustment hole 64. Weight 104 is shown in a first raised position. The user's U has not contracted the user's abdominal muscles to start the exercise regimen. The user's arms are in an extended position away from the user's chest.

Figure 20:
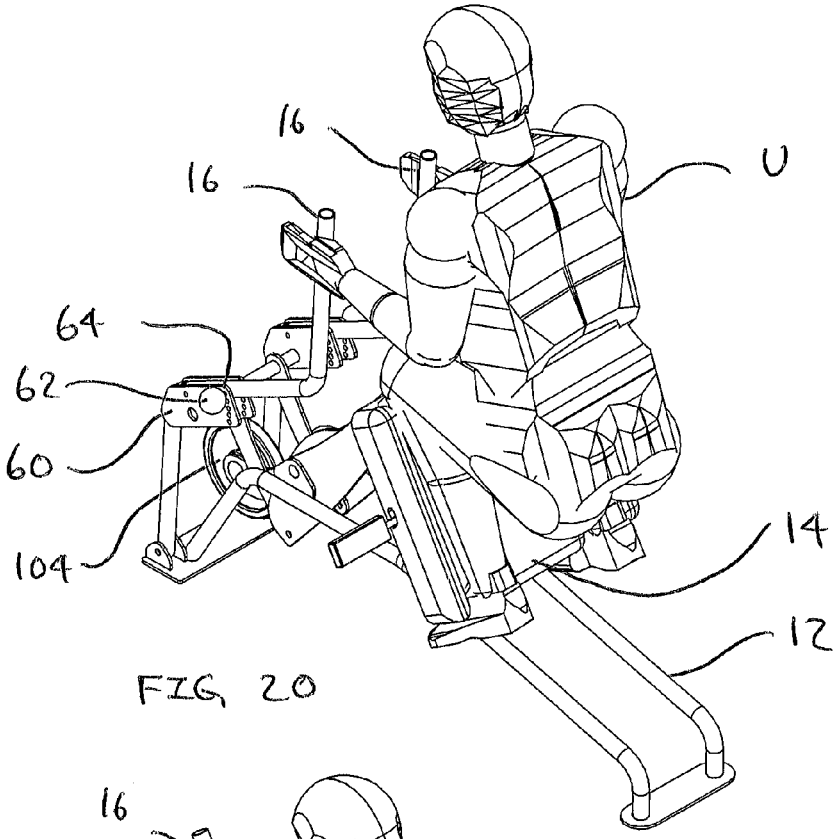
FIG. 20 is a left rear perspective view of a second embodiment of the invention in the activated position illustrating adjustable arm levers.
Figure 21:
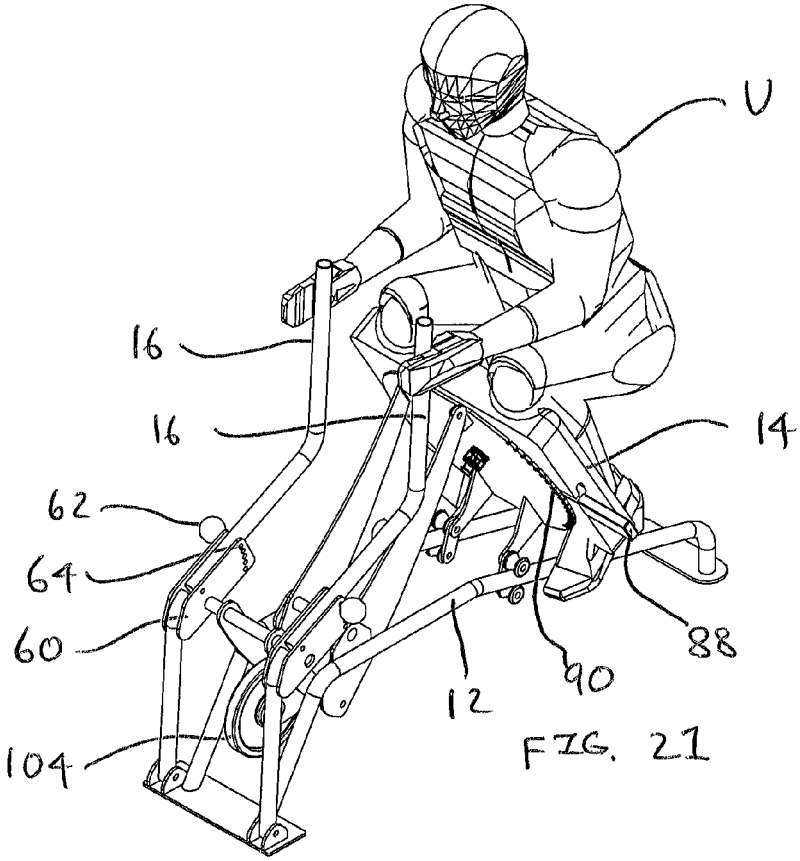
FIG. 21 is a left front perspective view of a second embodiment of the invention in the activated position illustrating adjustable arm levers.

Referring now to FIGS. 20-21, perspective views of the second embodiment are shown in the activated position illustrating adjustable arm levers. User U is still kneeling on the user platform 14 and is still grasping arm levers 16. User platform 14 is shown in the activated position towards the middle of the base 12 and in an angled position. Arm levers 16 are shown in the activated position towards the middle of the base 12. Arm levers 14 are shown in a first position relative to adjustment plate 60 as illustrated by the placement of adjustment pin 62 in the first adjustment hole 64. Weight 104 is shown in a second lowered position. The user's U has contracted the user's abdominal muscles for start the exercise regimen, and the user's knees are located closer to the user's chest. The user's arms are in a contracted position closer to the user's chest.

Figure 22:
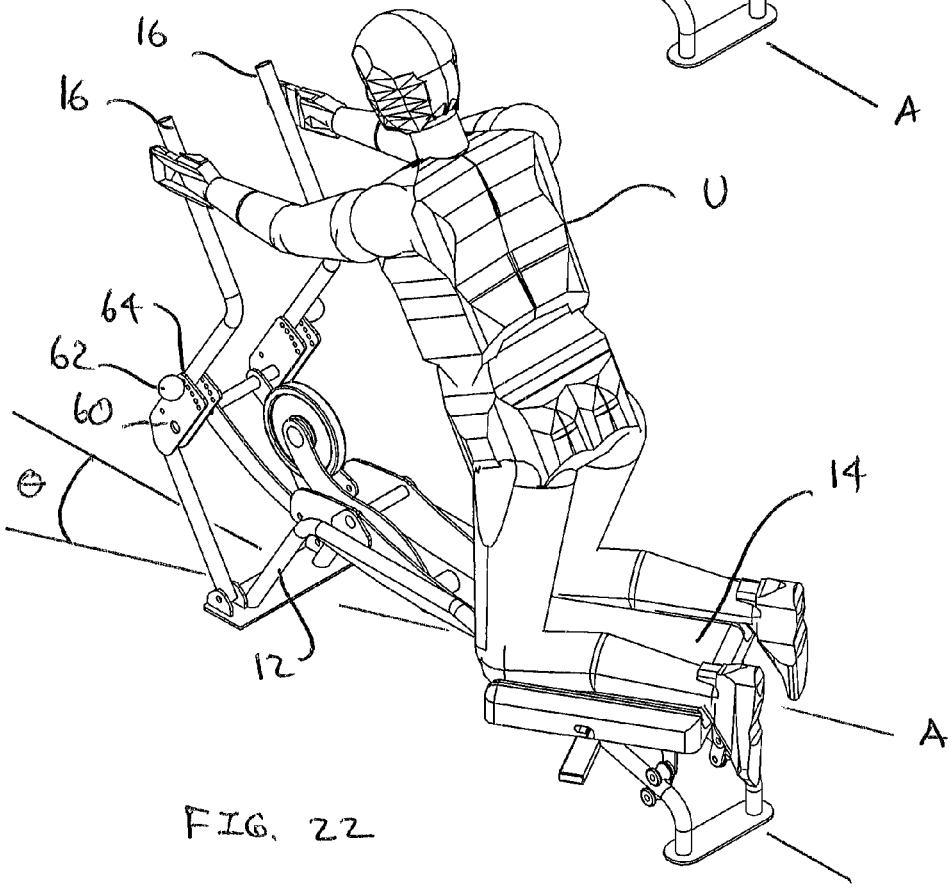
FIG. 22 is a left rear perspective view of a second embodiment of the invention in the at rest or unactivated position illustrating adjustable arm levers and rotation of the user platform.
Figure 23:
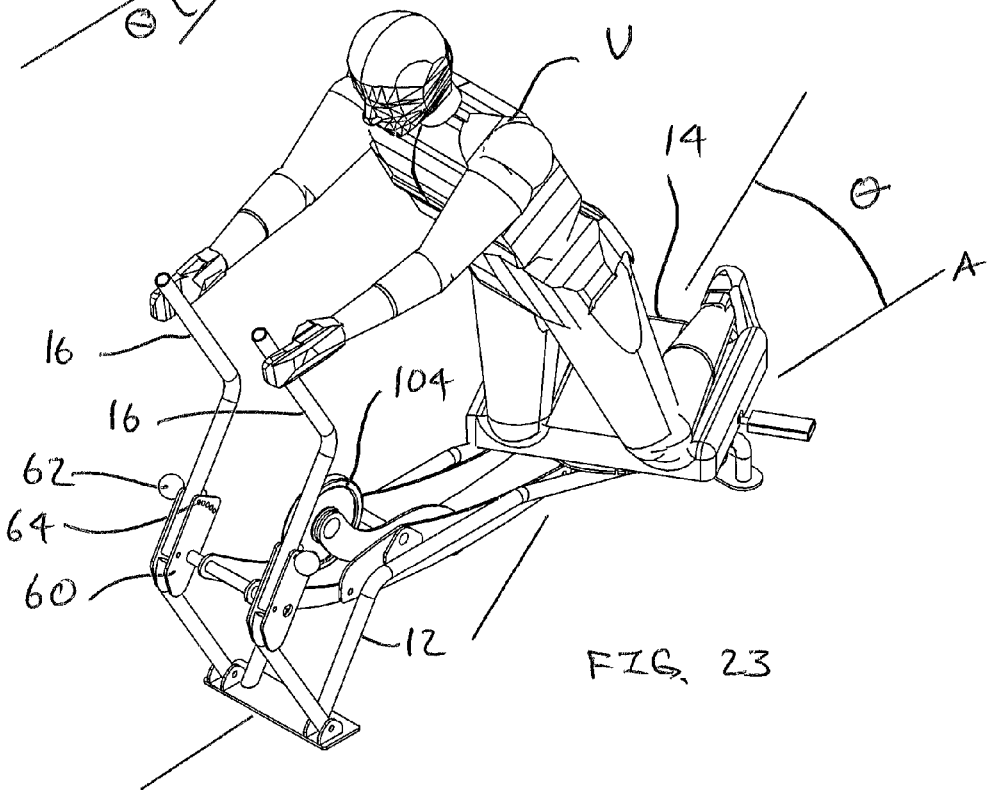
FIG. 23 is a left front perspective view of a second embodiment of the invention in the at rest or unactivated position illustrating adjustable arm levers and rotation of the user platform.
Figure 28:
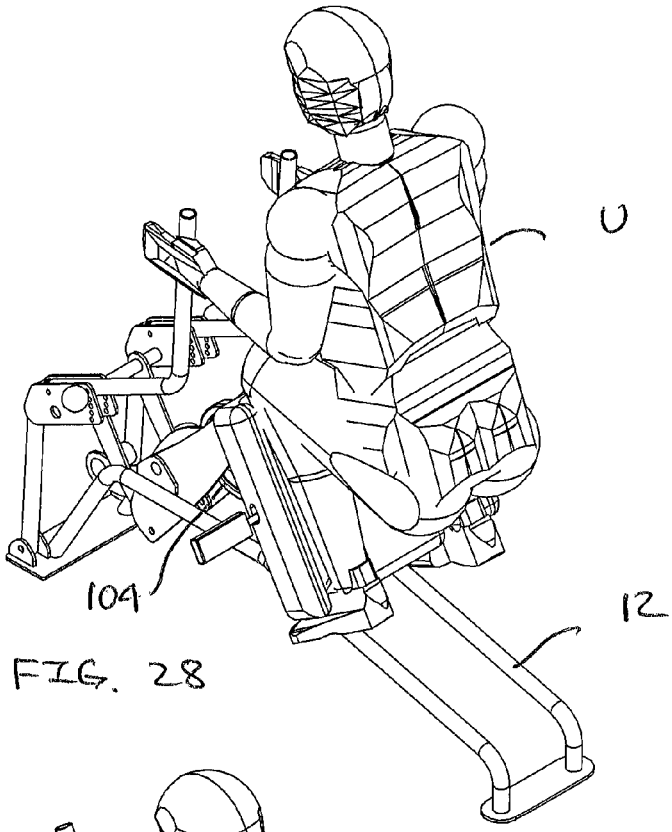
FIG. 28 is a left rear perspective view of the second embodiment of the invention in the activated position showing adjustable arm levers and an alternative use of a resistance or assistance mechanism.
Figure 26:
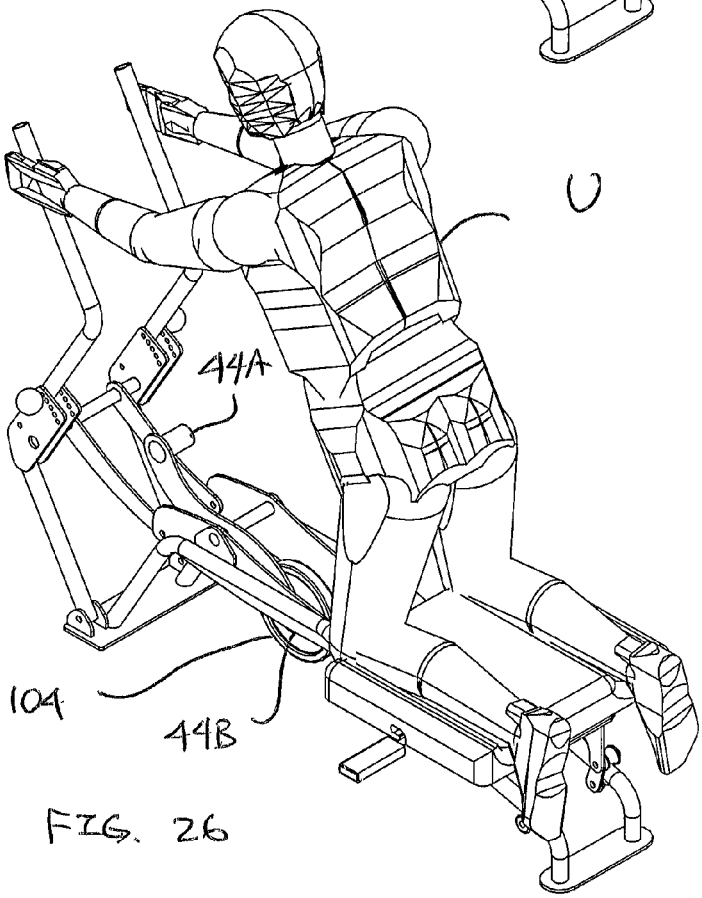
FIG. 26 is a left rear perspective view of a second embodiment of the invention in the at rest or unactivated position showing adjustable arm levers and an alternative use of a resistance or assistance mechanism.
Figure 29:
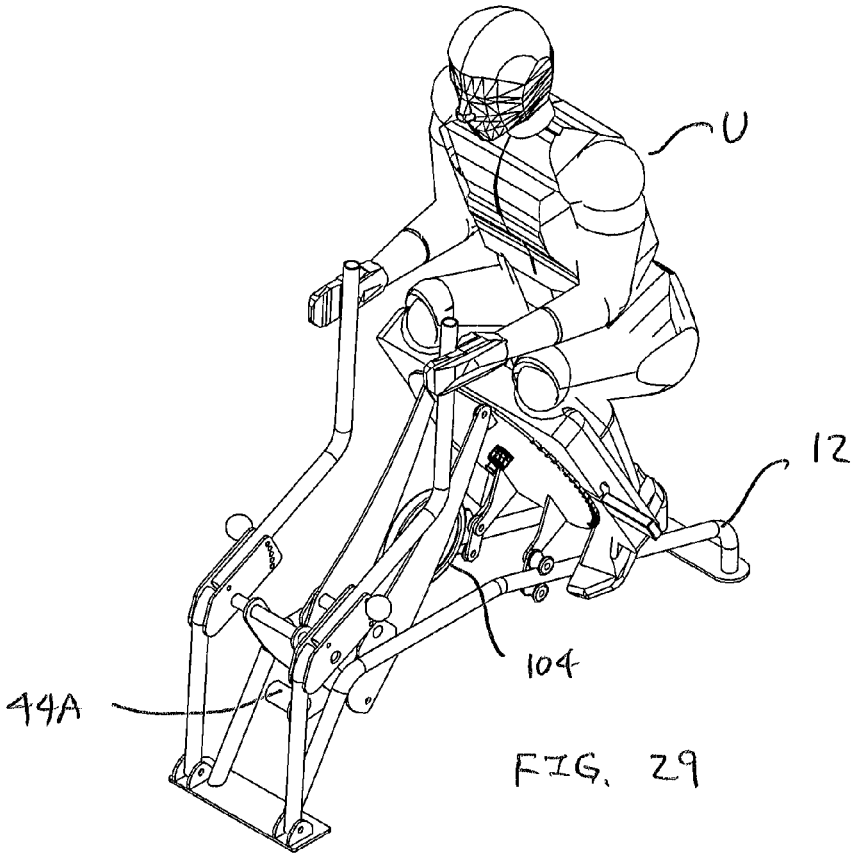
FIG. 29 is a left front perspective view of the second embodiment of the invention in the activated position showing adjustable arm levers and an alternative use of a resistance or assistance mechanism.
Figure 27:
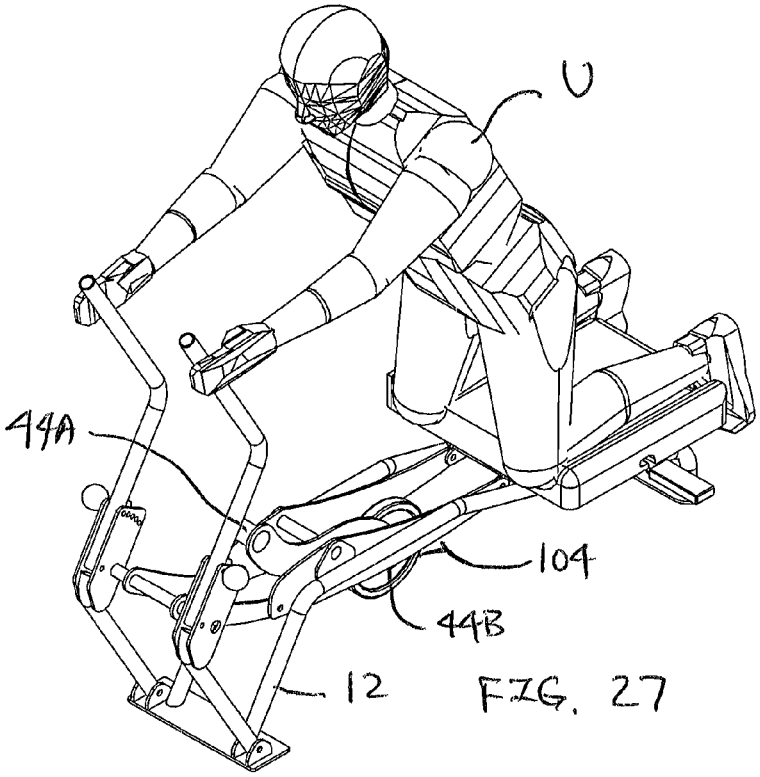
FIG. 27 is a left front perspective view of the second embodiment of the invention in the at rest or unactivated position showing adjustable arm levers and an alternative use of a resistance or assistance mechanism.
Figure 32:
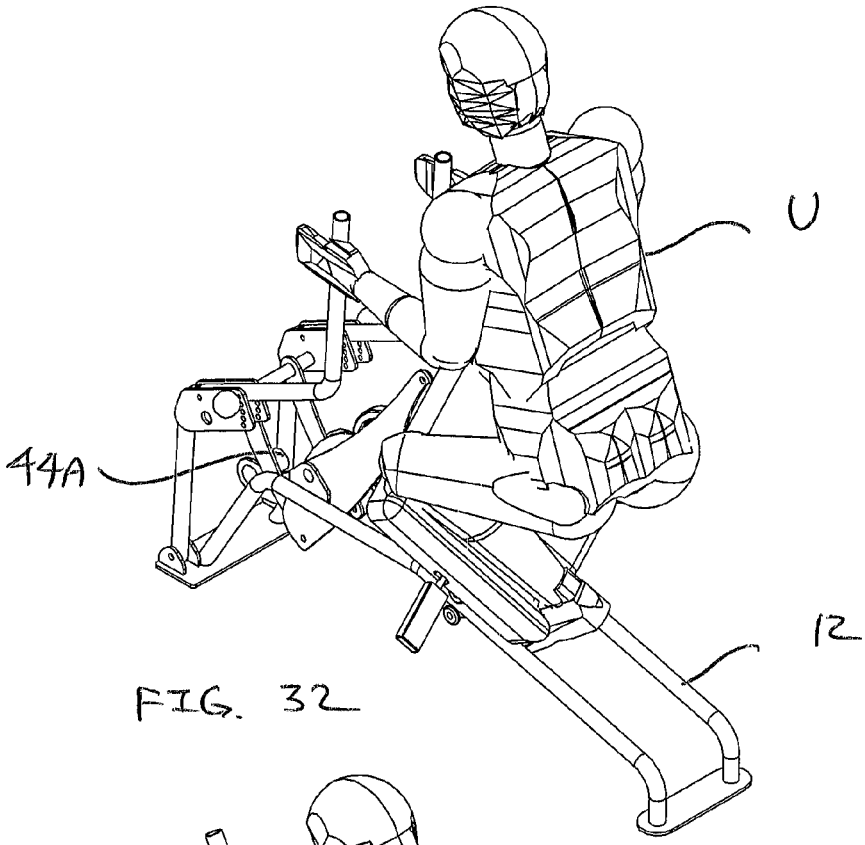
FIG. 32 is a left rear perspective view of the second embodiment of the invention in the activated position showing adjustable arm levers and an alternative use of a resistance or assistance mechanism and rotation of the user platform.
Figure 30:
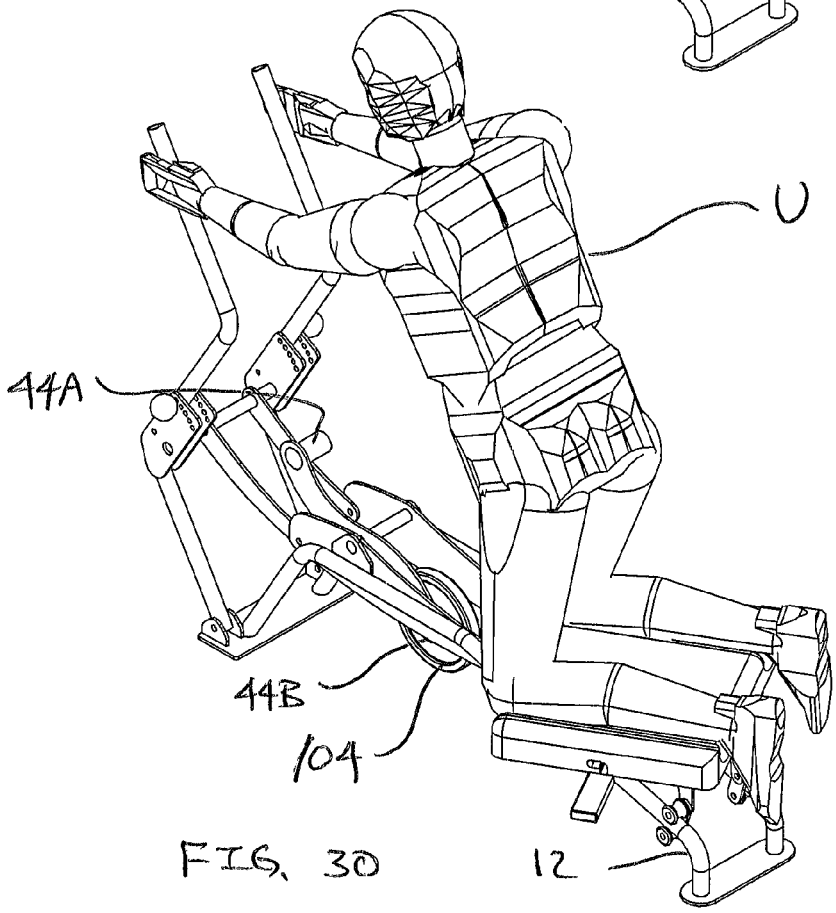
FIG. 30 is a left rear perspective view of the second embodiment of the invention in the at rest or unactivated position showing adjustable arm levers and an alternative use of a resistance or assistance mechanism and rotation of the user platform.
Figure 33:
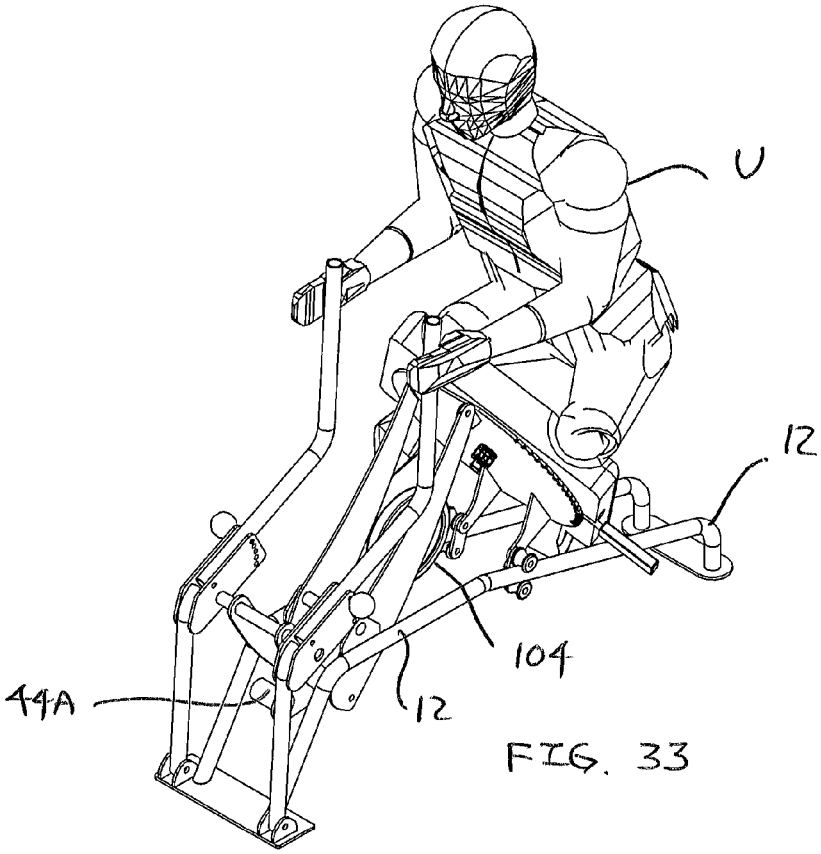
FIG. 33 is a left front perspective view of the second embodiment of the invention in the activated position showing adjustable arm levers and an alternative use of a resistance or assistance mechanism and rotation of the user platform.
Figure 31:
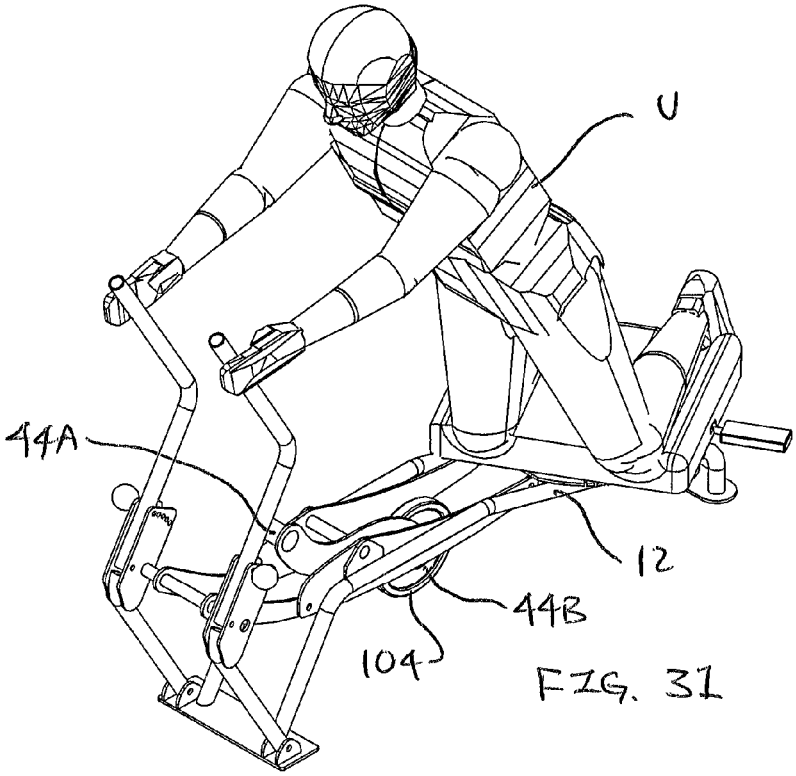
FIG. 31 is a left front perspective view of the second embodiment of the invention in the at rest or unactivated position showing adjustable arm levers and an alternative use of a resistance or assistance mechanism and rotation of the user platform.

Referring now to FIGS. 22-23, perspective views of the second embodiment are shown in the at rest or unactivated position illustrating adjustable arm levers and rotation of the user platform. User U is kneeling on the user platform 14 and is grasping arm levers 16. User platform 14 is shown in the at rest position towards the back of the base 12 and in a generally horizontal position. However, in these views, user platform 14 is shown rotated so as to be at an angle Θ relative to a linear axis A of base 12 horizontal to the floor and parallel to tubes 20. User platform 14 can be locked in this position using locking lever and pin 88 and locking hole 90 or user platform 14 can be in free rotation controlled by the user U. Arm levers 16 are shown in the at rest position towards the front of the base 12. Arm levers 14 are shown in a first position relative to adjustment plate 60 as illustrated by the placement of adjustment pin 62 in the first adjustment hole 64. Weight 104 is shown in a first raised position. The user's U has not contracted the user's abdominal muscles to start the exercise regimen. The user's arms are in an extended position away from the user's chest.

Figure 24:
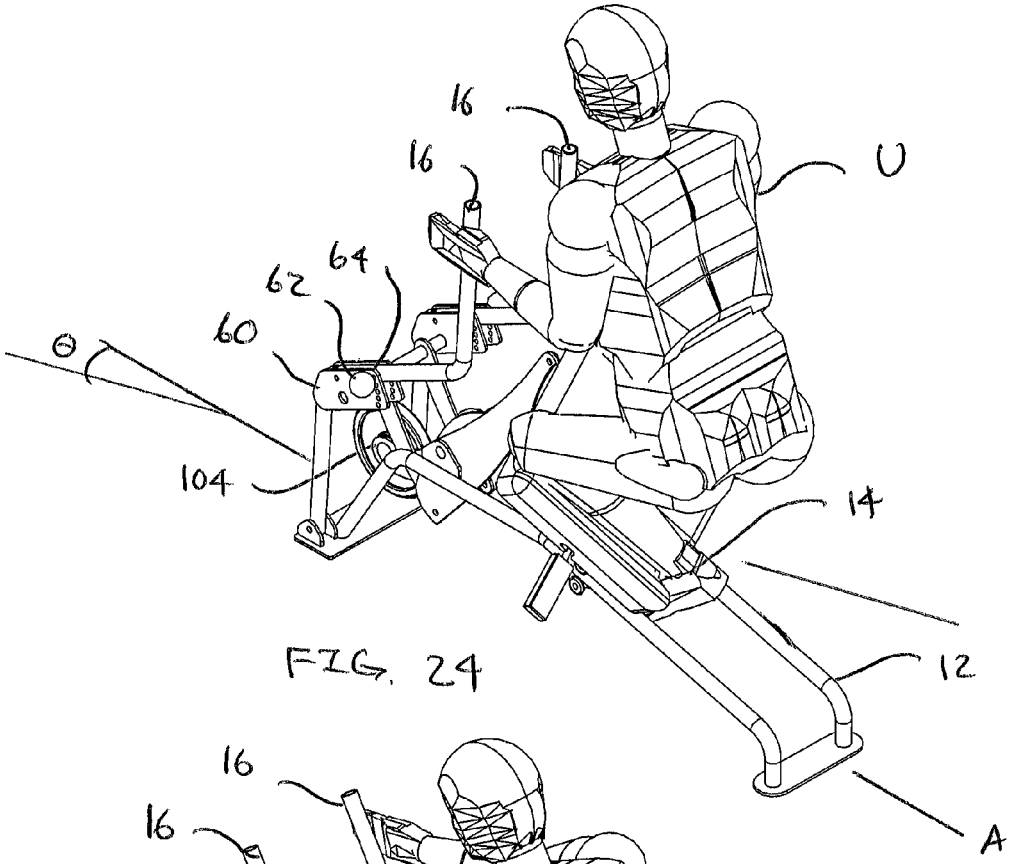
FIG. 24 is a left rear perspective view of a second embodiment of the invention in the activated position illustrating adjustable arm levers and rotation of the user platform.
Figure 25:
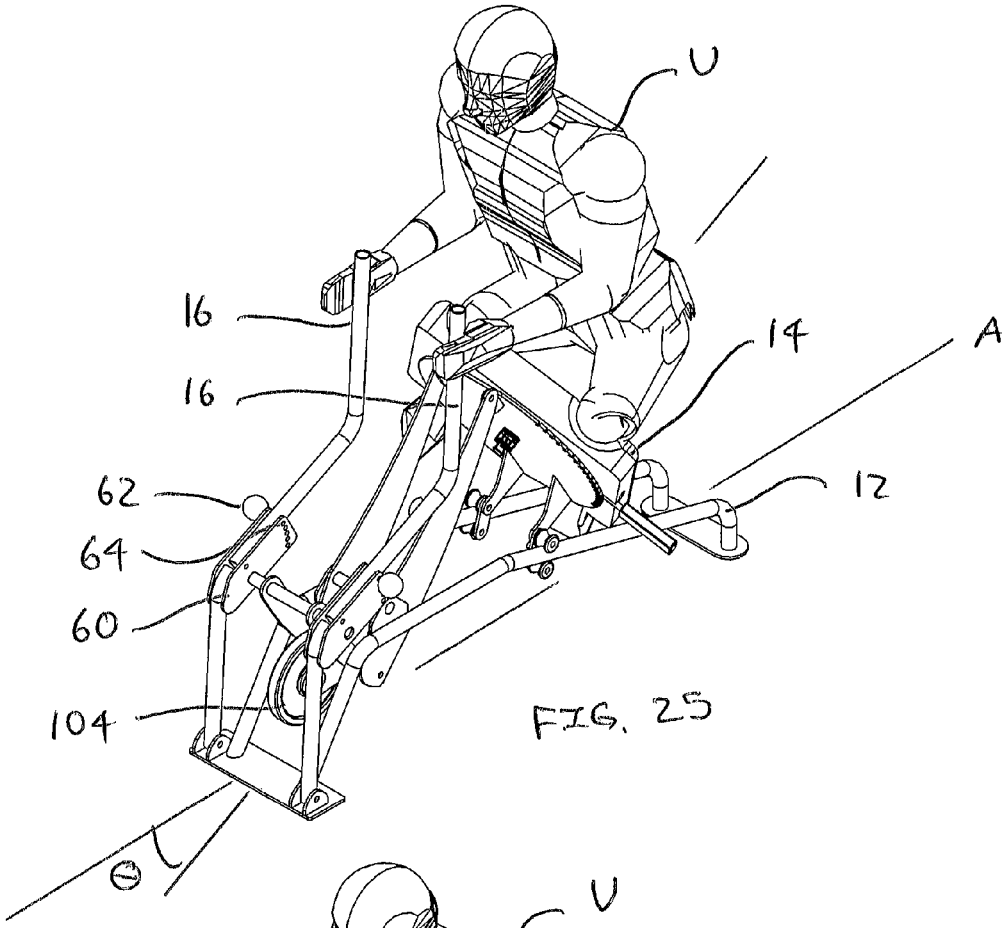
FIG. 25 is a left front perspective view of a second embodiment of the invention in the activated position illustrating adjustable arm levers and rotation of the user platform.

Referring now to FIGS. 24-25, perspective views of the second embodiment are shown in the activated position illustrating adjustable arm levers and rotation of the user platform. User U is still kneeling on the user platform 14 and is still grasping arm levers 16. User platform 14 is shown in the activated position towards the middle of the base 12 and in an angled position. However, in these views, user platform 14 is shown rotated so as to be at an angle Θ relative to a linear axis A of base 12 horizontal to the floor and parallel to tubes 20. User platform 14 can be locked in this position using locking lever and pin 88 and locking hole 90 or user platform 14 can be in free rotation controlled by the user U. Arm levers 16 are shown in the activated position towards the middle of the base 12. Arm levers 14 are shown in a first position relative to adjustment plate 60 as illustrated by the placement of adjustment pin 62 in the first adjustment hole 64. Weight 104 is shown in a second lowered position. The user's U has contracted the user's abdominal muscles for start the exercise regimen, and the user's knees are located closer to the user's chest. The user's arms are in a contracted position closer to the user's chest.

Referring now to FIGS. 26-33, perspective views of the second embodiment are shown in the at rest or unactivated position. FIGS. 26-33 show views that are analogous to the views shown in FIGS. 18-25, but with a weight 104 on the back weight bar 44B rather than on the front weight bar 44A.

Figure 35:
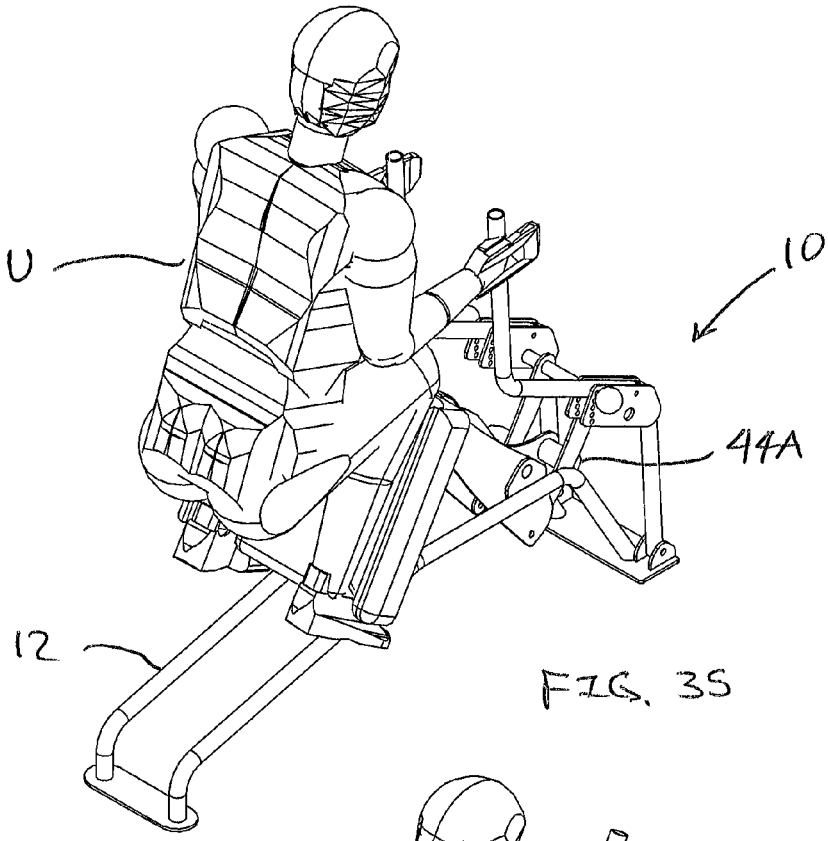
FIG. 35 is a right rear perspective view of the second embodiment of the invention in the activated position showing adjustable arm levers and an alternative use of a resistance or assistance mechanism.
Figure 34:
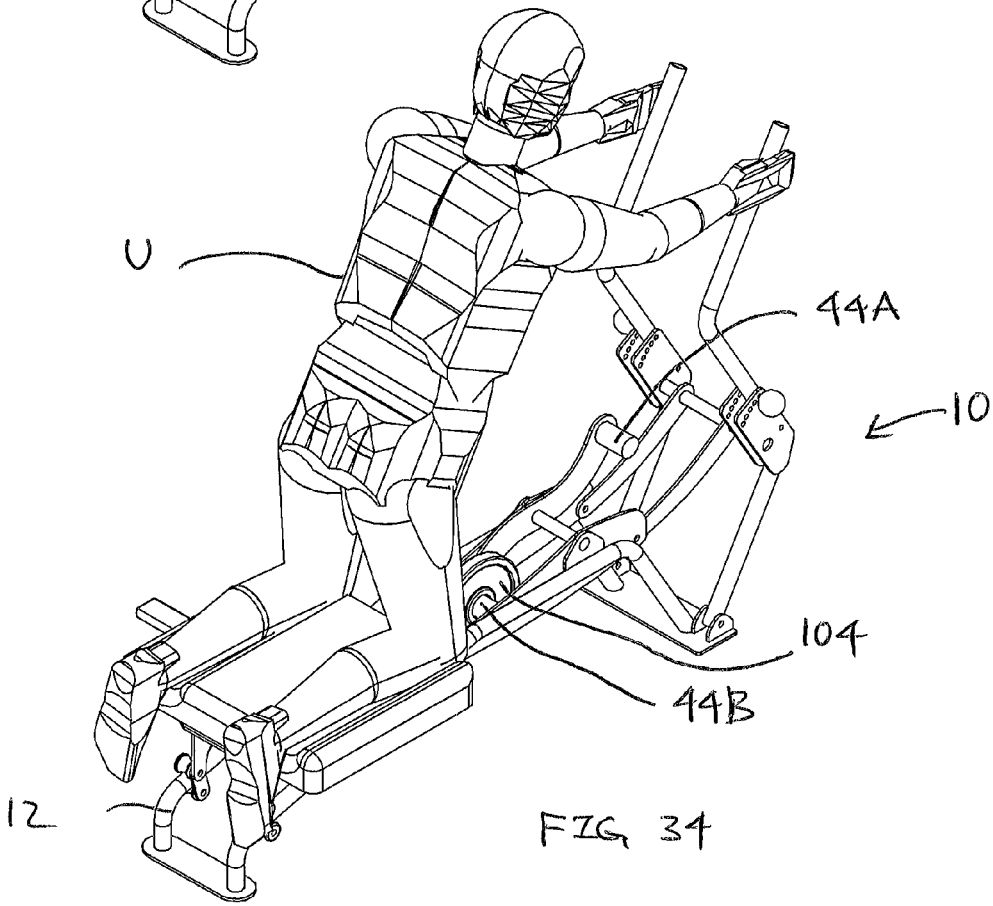
FIG. 34 is a right rear perspective view of the second embodiment of the invention in the at rest or unactivated position showing adjustable arm levers and an alternative use of a resistance or assistance mechanism.

Referring now to FIGS. 34-35, additional perspective views of the second embodiment are shown showing a weight 104 on the back weight bar 44B. FIG. 34 shows the machine 10 in the at rest or unactivated position and FIG. 35 shows the machine 10 in the activated position.

Figure 37:
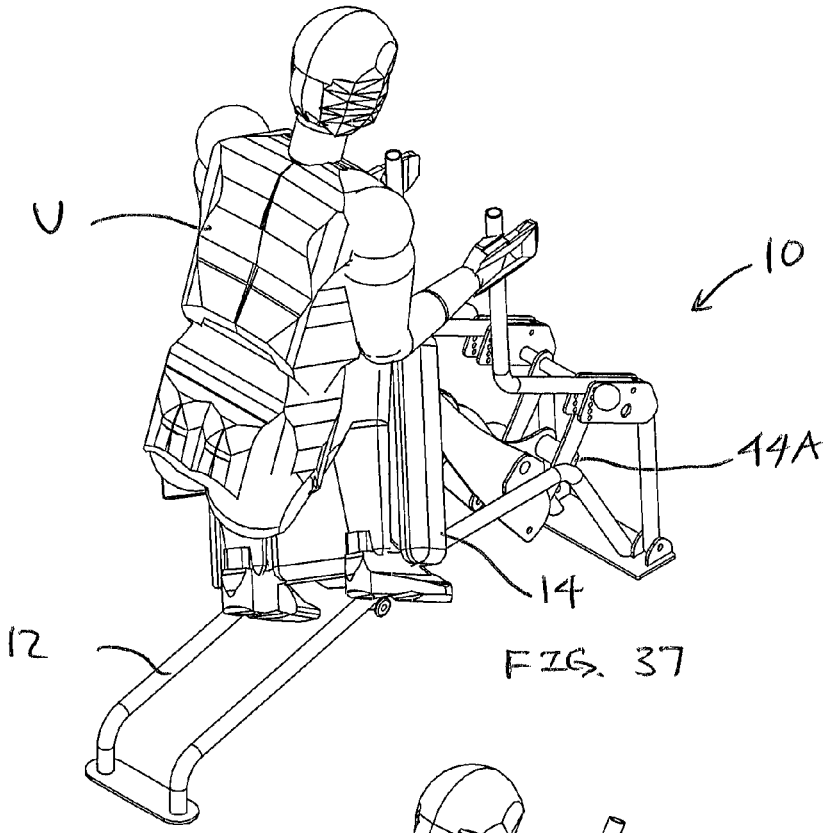
FIG. 37 is a right rear perspective view of the second embodiment of the invention in the activated position showing adjustable arm levers and an alternative use of a resistance or assistance mechanism and rotation of the user platform.
Figure 36:
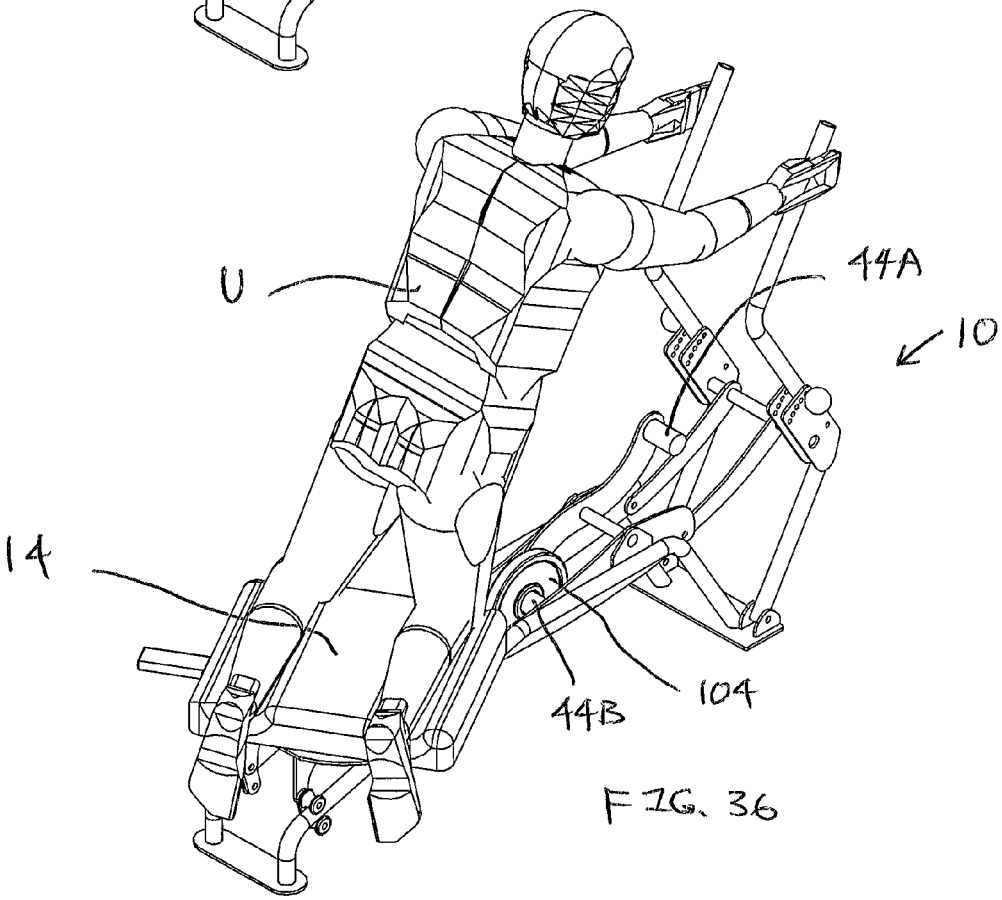
FIG. 36 is a right rear perspective view of the second embodiment of the invention in the at rest or unactivated position showing adjustable arm levers and an alternative use of a resistance or assistance mechanism and rotation of the user platform.

Referring now to FIGS. 36-37, additional perspective views of the second embodiment are shown with a rotated user platform 14 and showing a weight 104 on the back weight bar 44B. FIG. 36 shows the machine 10 in the at rest or unactivated position and FIG. 37 shows the machine 10 in the activated position.

Figure 38:
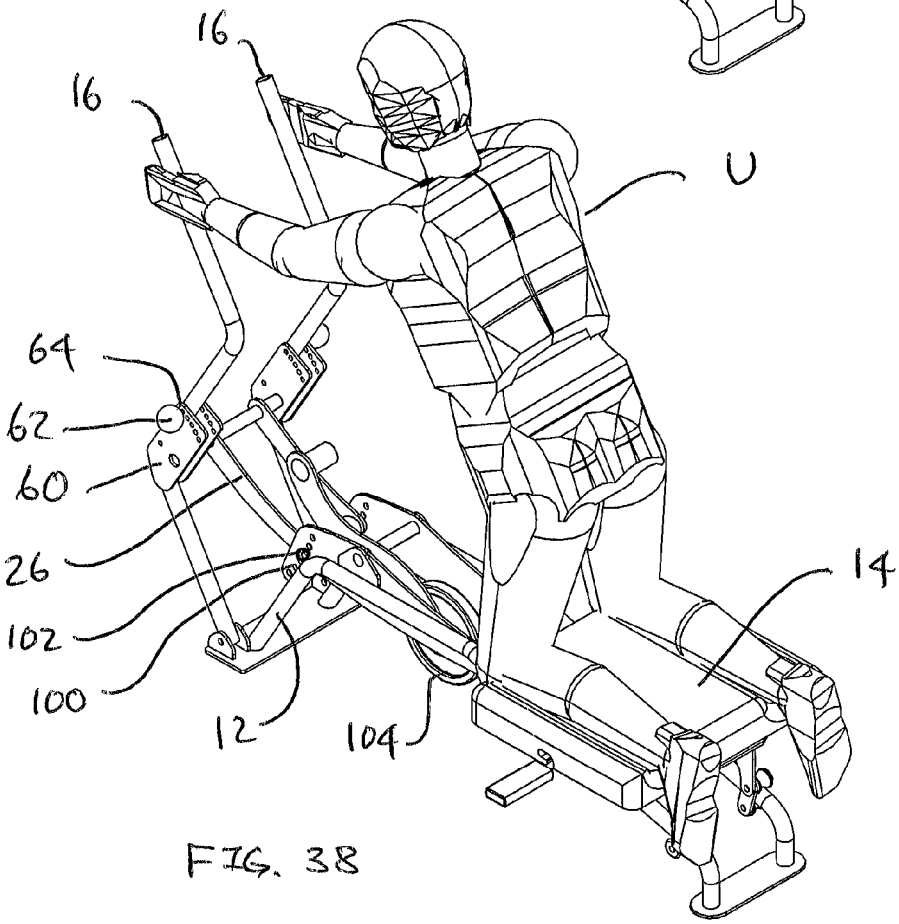
FIG. 38 is a left rear perspective view of the third embodiment of the invention in the at rest or unactivated position showing adjustable arm levers and an adjustable linkage mechanism and an alternative use of a resistance or assistance mechanism.
Figure 39:
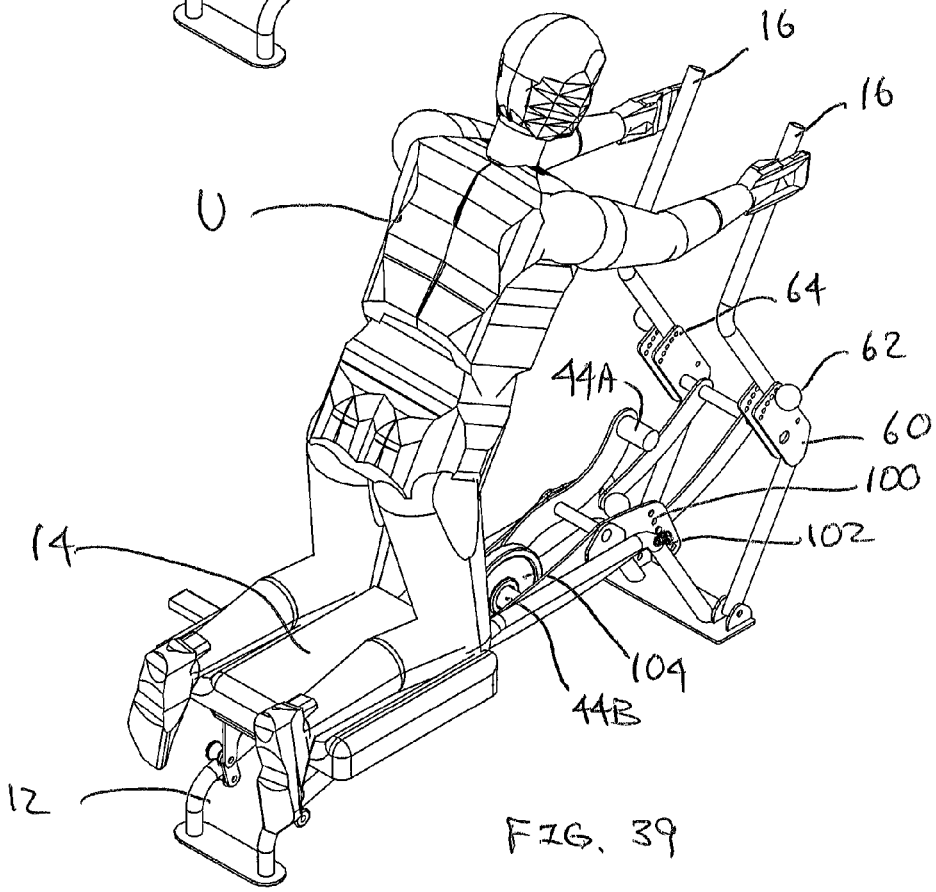
FIG. 39 is a right rear perspective view of the third embodiment of the invention in the at rest or unactivated position showing adjustable arm levers and an adjustable linkage mechanism and an alternative use of a resistance or assistance mechanism.
Figure 40:
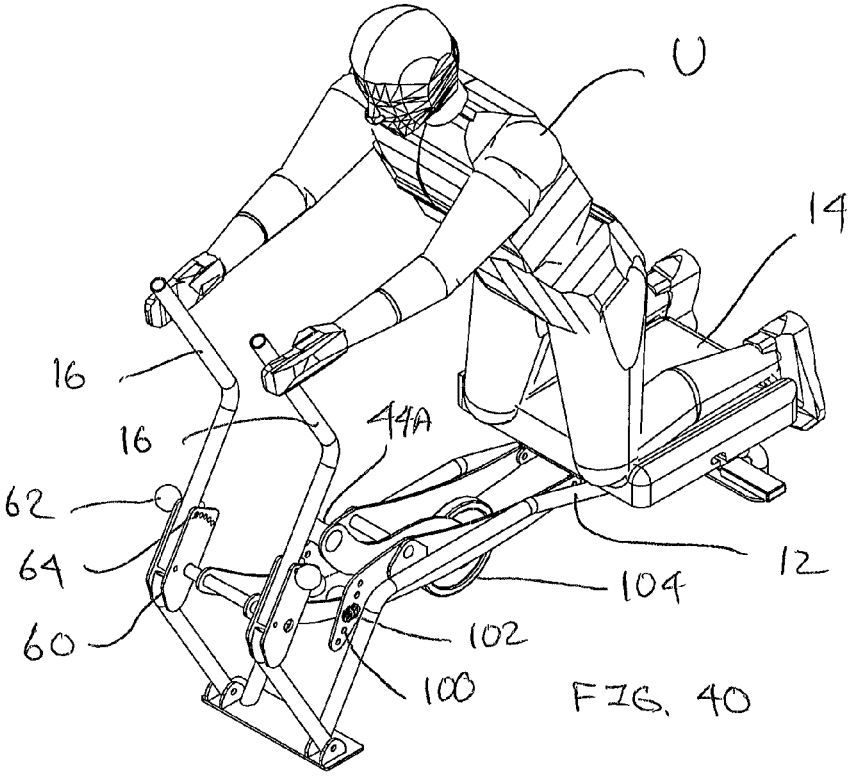
FIG. 40 is a left front perspective view of the third embodiment of the invention in the at rest or unactivated position showing adjustable arm levers and an adjustable linkage mechanism and an alternative use of a resistance or assistance mechanism.

Referring now to FIGS. 38-40, perspective views of the third embodiment are shown in the at rest or unactivated position illustrating adjustable arm levers and an adjustable linkage mechanism. User U is kneeling on the user platform 14 and is grasping arm levers 16. User platform 14 is shown in the at rest position towards the back of the base 12 and in a generally horizontal position. Arm levers 16 are shown in the at rest position towards the front of the base 12. Arm levers 14 are shown in a first position relative to adjustment plate 60 as illustrated by the placement of adjustment pin 62 in the first adjustment hole 64. First linkage 26 is shown in a third position relative to second linkage 28 as illustrated by the placement of linkage pivot 102 in the third adjustment hole 100. Weight 104 is shown in a first raised position. The user's U has not contracted the user's abdominal muscles to start the exercise regimen. The user's arms are in an extended position away from the user's chest.

Figure 41:
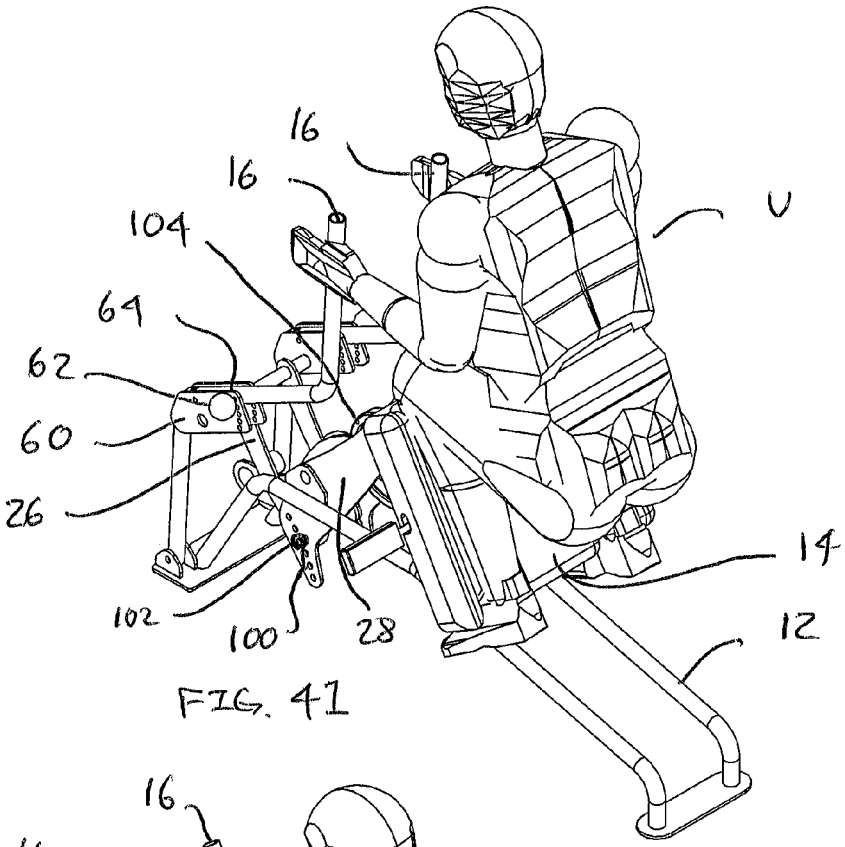
FIG. 41 is a left rear perspective view of the third embodiment of the invention in the activated position showing adjustable arm levers and an adjustable linkage mechanism and an alternative use of a resistance or assistance mechanism.
Figure 42:
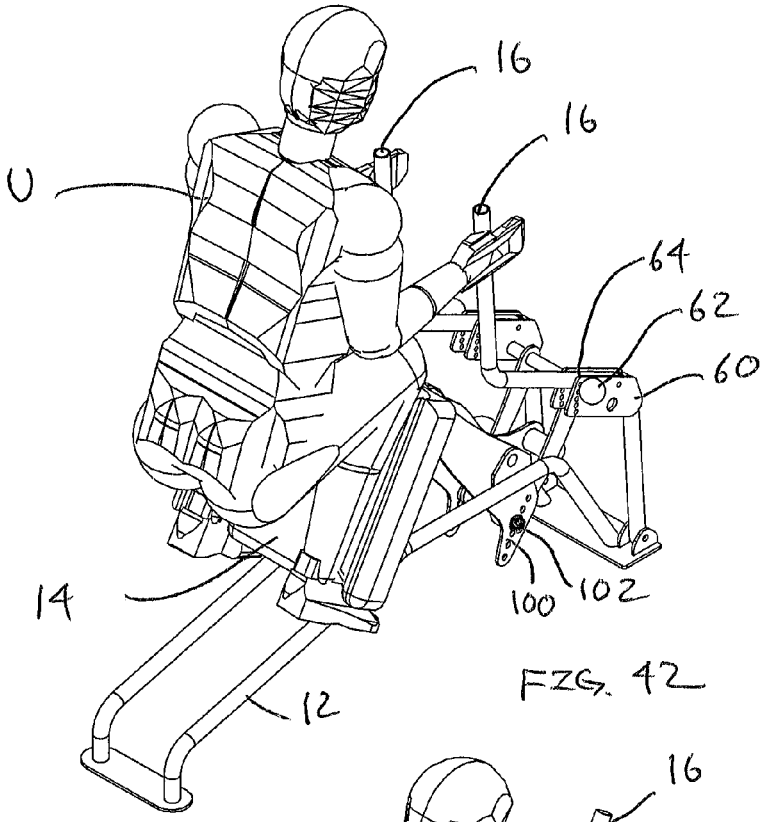
FIG. 42 is a right rear perspective view of the third embodiment of the invention in the activated position showing adjustable arm levers and an adjustable linkage mechanism and an alternative use of a resistance or assistance mechanism.
Figure 43:
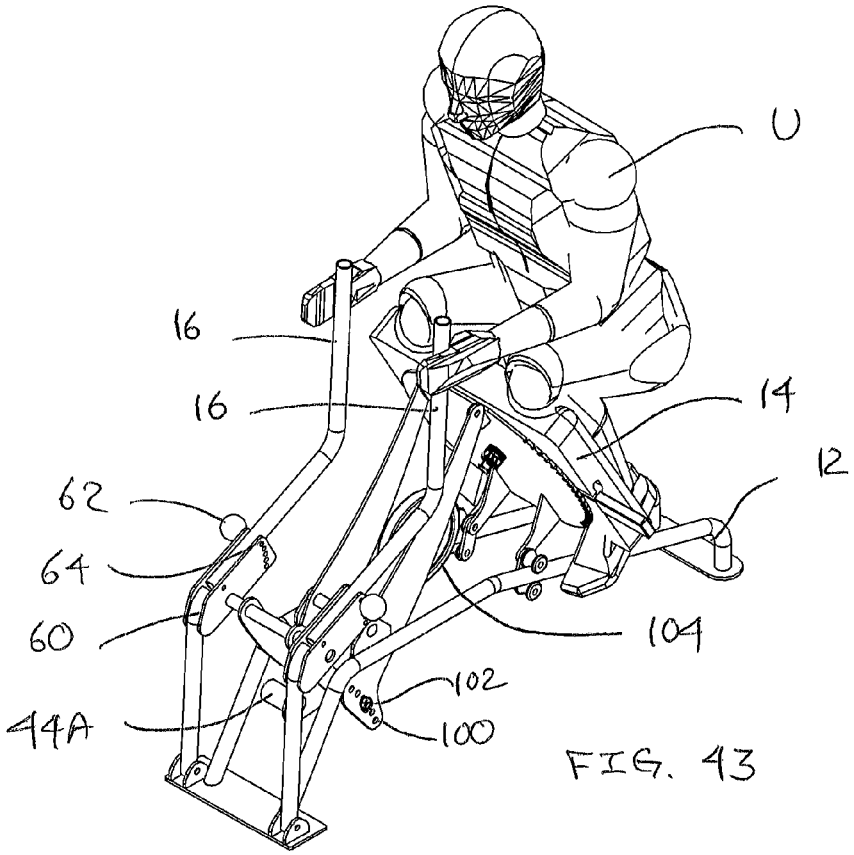
FIG. 43 is a left front perspective view of the third embodiment of the invention in the at rest or unactivated position showing adjustable arm levers and an adjustable linkage mechanism and an alternative use of a resistance or assistance mechanism.

Referring now to FIGS. 41-43, perspective views of the third embodiment are shown in the activated position illustrating adjustable arm levers and an adjustable linkage mechanism. User U is still kneeling on the user platform 14 and is still grasping arm levers 16. User platform 14 is shown in the activated position towards the middle of the base 12 and in an angled position. Arm levers 16 are shown in the activated position towards the middle of the base 12. Arm levers 14 are shown in a first position relative to adjustment plate 60 as illustrated by the placement of adjustment pin 62 in the first adjustment hole 64. First linkage 26 is shown in a third position relative to second linkage 28 as illustrated by the placement of linkage pivot 102 in the third adjustment hole 100. Weight 104 is shown in a second lowered position. The user's U has contracted the user's abdominal muscles for start the exercise regimen, and the user's knees are located closer to the user's chest. The user's arms are in a contracted position closer to the user's chest.

The invention also can include adjustment means or mechanisms so as to allow the user platform 14, the arm levers 16, the rotation bearing support plate 72, and/or the resistance or assistance mechanism 18 to be adjusted to fit the user U. Thus, each of the components of the invention is or can be adjustable so as to provide a comfortable and appropriate exercise regimen.

The present invention is an exercise machine 10 for primarily exercising the abdominal muscles, and also exercising at least one additional muscle or muscle group, such as latissumus dorsi, tensor fasciae latae, quadriceps, the biceps, the deltoids, and/or the trapezius, among others, depending on how the machine 10 is used. In operation, prior to initiating the exercise regimen, the user U can adjust the position of the arm levers 16, the position of linkage mechanism 24, the position of the user platform 14, and/or the angle Θ of the user platform 14, if adjustment mechanisms are included. Also, if the machine 10 includes an additional resistance or assistance mechanism 18, the user U can adjust the amount of additional resistance or assistance desired for the exercise regimen.

The user U kneels on the user platform 14 and grasps the arm levers 16, which are in the at rest or unactivated position. The user U pulls on the arm levers 16 while contracting the abdominal muscles. The pulling on the arm levers 16 causes the first linkage 26 to move or rotate or pivot in a downward direction, thus forcing and rotating or pivoting the first end 28A of the second linkage 28 downwards, thus causing the second end 28B of the second linkage 28 to rotate or pivot upwards. As the second end 28B of the second linkage 28 rotates or pivots upwards, the second end 28B of the second linkage 28 also moves in the direction of and closer to the arm levers 16, thus both pulling the user platform 14 forwards and forcing the front end 80 of the user platform 14 upwards, resulting in the user platform 14 angling upwards from back to front. The contracting of the abdominal muscles also causes the user's hips to rotate forwards, thus also pulling the user platform 14 forward. The overall result is that the user U conducts a crunch motion in which the user's knees are pulled towards the user's head and shoulders. The user U may pull the arm levers 16 part way or all the way to the fully activated position.

After the user U has pulled the arm levers 16 part way or all the way to the fully activated position so as to have conducted the crunch motion, the user U can hold the arm levers 16 in the activated position for additional exercise of the abdominal muscles. The user U then allows the arm levers 16 to move back towards or to the at rest position, which causes the first linkage 26 to move or rotate or pivot in an upward direction, thus forcing or allowing and rotating or pivoting the first end 28A of the second linkage 28 upwards, thus causing the second end 28B of the second linkage 28 to rotate or pivot downwards. As the second end 28B of the second linkage 28 rotates or pivots downwards, the second end 28B of the second linkage 28 also moves in the direction away from and farther from the arm levers 16, thus both pushing the user platform 14 backwards and forcing the front end 80 of the user platform 14 downwards, resulting in the user platform 14 moving back to the horizontal, generally horizontal, or slightly inclined starting position.

Additionally, when the user U pulls and pushes the arm levers 14, the user U can contract and release arm and/or back muscles, such as the biceps, deltoids, and/or trapezius, therefore also exercising these muscles. Further, when the user U moves the user platform U, the user can contract and release the quadriceps muscles and/or hip flexor tensor fasciae latae, therefore also exercising these muscles.

The user U can repeat the pulling and pushing (releasing) action on the arm levers 16 a number of times so as to complete a set of exercises. As can be seen, the present invention can exercise at least the abdominal muscles and also at least one other muscle or set of muscles, thus giving the user U a more complete workout.

The present invention can be used in at least three modes, user resistance, user plus additional resistance, and user resistance with counter resistance assistance. In the user resistance mode, the user's body weight is the only form of resistance used to conduct the exercise regimen. In one embodiment of the user resistance mode, the mechanical advantage or disadvantage to the user can be manipulated with certain adjustments incorporated into the structure of the invention to increase or decrease the difficulty of the exercise regimen. In the user plus additional resistance mode, additional resistance can be added via an optional resistance or assistance mechanism, such as free weights, a weight stack, hydraulic devices, pneumatic devices, clutch-brake devices, elastic devices, friction devices, springs, moment arm devices, or other weight resistance devices and mechanisms. In the user resistance with counter resistance assistance mode, a counter resistance force can be added such as free weights, a weight stack, gas springs, spring powered reels or the like to create a counter force that will effectively reduce the amount of resistance of the exercise created by the user's body weight, thereby effectively reducing the difficulty of the exercise regimen.

While the invention has been described in connection with certain preferred embodiments, it is not intended to limit the spirit or scope of the invention to the particular forms set forth, but is intended to cover such alternatives, modifications, and equivalents as may be included within the true spirit and scope of the invention as defined by the appended claims.

What is claimed is:

1. An exercise machine for exercising at least a user's abdominal muscles, the machine comprising:

a) a base having a front end and a back end;

b) an arm lever actuated by a user's upper body, the arm lever being mounted to the base at or proximal to the front end of the base;

c) a user platform actuated by a user's lower body and/or by the arm levers, the user platform being slidably and pivotably mounted at or proximal to a back end of the user platform to the base at or proximal to the back end of the base; and d) a linkage mechanism operatively connecting the arm lever to the user platform, whereby when the arm lever is moved in a direction towards the user platform, the user platform is moved by the linkage mechanism towards the arm lever and a front end of the user platform is moved by the linkage mechanism upwards thereby pivoting the user platform into an angled configuration, and whereby when the arm lever is moved in a direction away from the user platform, the user platform is moved by the linkage mechanism away from the arm lever and the front end of the user platform is moved by the linkage mechanism downwards thereby pivoting the user platform into a horizontal configuration.

2. The exercise machine of claim 1, wherein the arm lever is movable between a first at rest position and a second fully activated position and can be maintained at any position between the first at rest position and the second fully activated position.

3. The exercise machine of claim 1, wherein the user platform also is rotatably connected to the base.

4. The exercise machine of claim 1, further comprising a rotation bearing support plate, wherein the rotation bearing support plate is operatively connected to the linkage mechanism and the user platform is rotatably connected to the rotation bearing support plate.

5. The exercise machine of claim 1, wherein the linkage mechanism comprises:

a first linkage having a first end and a second end; and a second linkage having a first end and a second end, wherein:

the first linkage is connected at the first end of the first linkage to or operatively proximal to the arm lever and the first linkage is connected at the second end of the first linkage to the first end of the second linkage;

the second linkage is connected at the first end of the second linkage to the second end of the first linkage and the second linkage is connected at the second end of the second linkage to or operatively proximal to the user platform.

6. The exercise machine of claim 5, wherein the first linkage is adjustably connected to the arm lever, providing for an initial angle of attachment between the first linkage and the arm lever that is adjustable.

7. The exercise machine of claim 5, wherein the first linkage is adjustably connected to the second linkage, providing for an initial angle of attachment between the first linkage and the second linkage that is adjustable.

8. The exercise machine of claim 5, wherein the second linkage is pivotably mounted to the base at a location on the base between the arm lever and the user platform.

9. The exercise machine of claim 8, wherein the second linkage has a pivot point that is located between the first end of the second linkage and the second end of the second linkage such that the second linkage is a first class lever.

10. The exercise machine of claim 1, further comprising a resistance or assistance mechanism operatively connected to the arm lever, to the linkage mechanism, and to the user platform, whereby when the arm lever is moved in the direction towards the user platform the resistance or assistance mechanism is activated.

11. The exercise machine of claim 10, wherein the resistance or assistance mechanism is selected from the group consisting of free weights, weight stacks, hydraulic devices, pneumatic devices, brake-clutch devices, elastic devices, friction devices, springs, and moment arm devices.

12. The exercise machine of claim 10, wherein the resistance or assistance mechanism comprises a weight bar attached to the exercise machine and free weights that can be placed on and removed from the weight bar.

13. The exercise machine of claim 12, wherein the resistance or assistance mechanism is rigidly attached to the linkage mechanism.

14. The exercise machine of claim 5, further comprising a resistance or assistance mechanism operatively connected to the arm lever, to the linkage mechanism, and to the user platform, whereby when the arm lever is moved in the direction towards the user platform the resistance or assistance mechanism is activated, wherein:

the resistance or assistance mechanism comprises a weight bar attached to the exercise machine and free weights that can be placed on and removed from the weight bar, and the resistance or assistance mechanism is rigidly attached to the linkage mechanism.

15. An exercise machine for exercising at least a user's abdominal muscles, the machine comprising:

a) a base having a front end and a back end;

b) an arm lever actuated by a user's upper body, the arm lever being mounted to the base at or proximal to the front end of the base;

c) a user platform actuated by a user's lower body and/or by the arm levers, the user platform being slidably and pivotably mounted at or proximal to a back end of the user platform to the base at or proximal to the back end of the base;

d) a linkage mechanism operatively connecting the arm lever to the user platform; and e) a resistance or assistance mechanism operatively connected to the arm lever, to the linkage mechanism, and to the user platform, whereby when the arm lever is moved in the direction towards the user platform the resistance or assistance mechanism is activated, whereby when the arm lever is moved in a direction towards the user platform, the user platform is moved by the linkage mechanism towards the arm lever and a front end of the user platform is moved by the linkage mechanism upwards thereby pivoting the user platform into an angled configuration, and whereby when the arm lever is moved in a direction away from the user platform, the user platform is moved by the linkage mechanism away from the arm lever and the front end of the user platform is moved by the linkage mechanism downwards thereby pivoting the user platform into a horizontal configuration.

16. The exercise machine of claim 15, wherein the linkage mechanism comprises:

a first linkage having a first end and a second end; and a second linkage having a first end and a second end, wherein:

the first linkage is connected at the first end of the first linkage to or operatively proximal to the arm lever and the first linkage is connected at the second end of the first linkage to the first end of the second linkage;

the second linkage is connected at the first end of the second linkage to the second end of the first linkage and the second linkage is connected at the second end of the second linkage to or operatively proximal to the user platform.

17. The exercise machine of claim 16, wherein:

wherein the resistance or assistance mechanism is selected from the group consisting of free weights, weight stacks, hydraulic devices, pneumatic devices, brake-clutch devices, elastic devices, friction devices, springs, and moment arm devices, and the resistance or assistance mechanism is rigidly attached to the linkage mechanism.

18. The exercise machine of claim 17, wherein the resistance or assistance mechanism comprises a weight bar and free weights that can be placed on and removed from the weight bar.

19. The exercise machine of claim 18, wherein the second linkage is pivotably mounted to the base at a location on the base between the arm lever and the user platform.

20. The exercise machine of claim 19, wherein the second linkage has a pivot point that is located between the first end of the second linkage and the second end of the second linkage such that the second linkage is a first class lever.

* * * * *